US006443563B1

(12) United States Patent
Saito et al.

(10) Patent No.: US 6,443,563 B1
(45) Date of Patent: Sep. 3, 2002

(54) ELECTRO-THERMAL CONVERSION DEVICE BOARD, INK-JET RECORDING HEAD PROVIDED WITH THE ELECTRO-THERMAL CONVERSION DEVICE BOARD, INK-JET RECORDING APPARATUS USING THE SAME, AND PRODUCTION METHOD OF INK-JET RECORDING HEAD

(75) Inventors: Ichiro Saito; Masashi Kitani, both of Yokohama; Yoshiyuki Imanaka, Kawasaki; Teruo Ozaki, Yokohama; Toshimori Miyakoshi, Yokohama; Muga Mochizuki, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/427,614

(22) Filed: Oct. 27, 1999

(30) Foreign Application Priority Data

Oct. 27, 1998 (JP) ..... 10-322878
Oct. 27, 1998 (JP) ..... 10-322879
Oct. 27, 1998 (JP) ..... 10-322880
Oct. 30, 1998 (JP) ..... 10-311050

(51) Int. Cl.[7] ..... B41J 2/05; B41J 2/14
(52) U.S. Cl. ..... 347/65; 347/48
(58) Field of Search ..... 347/37, 48, 49, 347/50, 55, 58, 59, 62, 63, 65; 205/122

(56) References Cited

U.S. PATENT DOCUMENTS 5,479,197 A 12/1995 Fujikawa et al. ..... 347/63
5,580,468 A 12/1996 Fujikawa et al. ..... 216/27
5,841,448 A 11/1998 Moriyama et al. ..... 347/19
5,858,197 A * 1/1999 Takahashi ..... 205/122
6,003,973 A 12/1999 Kamiyama et al. ..... 347/48

FOREIGN PATENT DOCUMENTS

| | | | |
|---|---|---|---|
| EP | 0 636 478 | 2/1995 | |
| EP | 0 636 480 | 2/1995 | |
| EP | 0 674 995 | 10/1995 | |
| EP | 0 800 921 | 10/1997 | |
| EP | 816 084 A2 * | 1/1998 | ..... B41J/2/05 |
| EP | 0 816 110 | 1/1998 | |
| EP | 0 819 531 | 1/1998 | |
| JP | 62-261452 | 11/1987 | |
| JP | 62-261453 | 11/1987 | |
| JP | 7-89073 | 4/1995 | |
| JP | 63 202455 | 8/1998 | |

* cited by examiner

*Primary Examiner*—Hai Pham
(74) *Attorney, Agent, or Firm*—Firzpatrick, Cella, Harper & Scinto

(57) ABSTRACT

Beneath electro-thermal conversion device layers having heaters, a common electrode layer electrically connected to heaters through branch connection parts is laminated through a protective film, and discrete electrodes are formed on an upper surface of the electro-thermal conversion device layers putting the branch connection parts between, respectively.

23 Claims, 27 Drawing Sheets

ELECTRO-THERMAL CONVERSION DEVICE BOARD, INK-JET RECORDING HEAD PROVIDED WITH THE ELECTRO-THERMAL CONVERSION DEVICE BOARD, INK-JET RECORDING APPARATUS USING THE SAME, AND PRODUCTION METHOD OF INK-JET RECORDING HEAD

This application is based on Japanese Patent Application Nos. 10-322878 (1998) filed Oct. 27, 1998, 10-322879 (1998) filed Oct. 27, 1998, 10-322880 (1998) filed Oct. 27, 1998, 10-311050 (1998) filed Oct. 30, 1998, the contents of which are incorporated hereinto by reference.

BACKGROUND OF THE INVENTION

1. Field of the Invention

The present invention relates to an electro-thermal conversion device board which includes an electro-thermal conversion device layer having a plurality of heat generation parts arranged corresponding to a liquid flow passage for conducting a liquid used for recording, an ink-jet recording head provided with the electro-thermal conversion device board, an ink-jet recording apparatus using the same, and a production method of an ink-jet recording head.

2. Description of the Related Art

In general, an ink-jet recording apparatus is provided with a recording head for ejecting an ink as a liquid used for recording. A bubble-jet type recording head, as shown in, for example, Japanese Patent Application Laid-open Nos. 62-261452 (1987) and 62-261453 (1987), comprises an ink ejection member having an ink ejection port forming surface on which a plurality of ink ejection ports for ejecting ink drops are formed at a predetermined interval, an electro-thermal conversion device board having electro-thermal conversion device layers arranged corresponding to respective ink flow passages communicating with respective ink eject ports, and a printed circuit board for supplying drive control signals to the respective electro-thermal conversion device layers of the electro-thermal conversion device board.

The ink ejection member is provided with a common liquid chamber which stores a predetermined amount of ink supplied from an ink tank. The common liquid chamber is communicated with an end of each ink flow passage formed by a partition wall member disposed in parallel and opposite to each other. Accordingly, this distributes the ink from the common liquid chamber to respective ink flow passages, which is ejected as an ink droplet from the ink ejection port.

In the electro-thermal conversion device board, for a multi-value recording system in which the size of ejected liquid-droplet is changed according to a multi-value recording image data, one is proposed in which a plurality of heat generation parts of a plurality of electro-thermal conversion device layers are respectively driven selectively.

The electro-thermal conversion device board, for example, as shown in FIGS. 17A and 17B, comprises a base table part 6 in which is disposed between an ink flow passage 2*ai* of the ink ejection member and a printed circuit board (not shown) of the electro-thermal conversion device layer, and a heat generation part 8*ai* (i=1 to n, n is an integer) and heat generation part 20*ai* (i=1 to n, n is an integer) of the electro-thermal conversion device layer are disposed on one of the surfaces according to each ink flow passage, a discrete electrode layer 10 with one end thereof electrically connected to the heat generation part 8*ai,* a discrete electrode layer 18 is flush with the discrete electrode layer 10 and having one end thereof electrically connected to the heat generation part 20*ai,* a common electrode layer 12 in which one end is electrically connected respectively to the heat generation part 8*ai* and the heat generation part 20*ai* and formed on the same plane as of the discrete electrode layers 10 and 18, a protective layer 16 covering all of the adjacent heat generation parts 8*ai* and 20*ai,* the discrete electrode layer 10, and the discrete electrode layer 18, and a cavitation resistant layer 14 covering the entire surface of the protective layer 16.

In FIGS. 17A and 17B, parts corresponding to the two ink flow passages 2*ai* (i=1 to n, n is an integer)of the ink ejection member are shown representatively, and other parts are omitted.

The heat generation part 8*ai* and the heat generation part 20*ai* are disposed on a common straight line along the same ink flow passage on the same plane of the base table part 6. The heat generation part 8*ai* is disposed at a position closer to the ink ejection port of the ink ejection member than the heat generation part 20*ai.* The capacity (heat generation amount) of the heat generation part 8*ai* is smaller than the capacity (heat generation amount) of the heat generation part 20*ai.*

The other end of the common electrode layer 12 formed on the heat generation part 8*ai* and the heat generation part 20*ai* is connected with a reference power supply for supplying a predetermined power.

The cavitation resistant layer 14 formed with a rough surface has shallow grooves correspondingly between respective partition wall members 4a*i* (i=1 to n, n is an integer) of the ink ejection member and also has elongate grooves 14*a* correspondingly to respective partition wall members 4*ai.*

Adjacent ink flow passages 2*ai* are formed independently without communication with each other by closely contacting one end of the partition wall member 4*ai* of the ink ejection member with the cavitation resistant layer 14 at a predetermined pressure.

In this case, the number of ink ejection ports has a tendency to increase recently in compliance to the requirement for high resolution of the resulting recording images, and therefore, in view of obtaining a compact recording head, the distance between adjacent ink flow passages and the distance between adjacent heat generation parts 8*ai* and heat generation parts 20*ai* also tend to be decreased.

When, as described above, a plurality of heat generation parts 8*ai* and heat generation parts 20*ai* are formed on a same straight line for each ink flow passage, and the discrete electrode layers 10 and 18 and the common electrode layer 12 are formed in parallel on a same plane, wiring between respective electrode layers and the reference power supply becomes complicated and relatively increased.

Further, when the number of ink ejection ports is increased to enhance image density, it is also considered that widths of the respective heaters, the discrete electrode layers 10 and 18, and the common electrode layer 12 are decreased to reduce the width of each ink flow passage. However, by decreasing the width of each heat generation part, there is a danger of deteriorating the heating efficiency and ink ejection performance, and still further, decrease in width of the discrete electrode layers 10 and 18 and the common electrode layer 12 has a certain limitation because of an increase in wiring resistance. Therefore, increased density of heat generation parts of the electro-thermal conversion device board and increased density of ink ejection ports and a compact electro-thermal conversion device board are not easy to realize.

In view of the above problems, a first object of the present invention is to provide an electro-thermal conversion device board having a plurality of heat generation parts arranged corresponding to liquid flow passages for conducting a liquid used for recording, an ink-jet recording head provided with an electro-thermal conversion device board, an ink-jet recording apparatus using the recording head, and a production method of the ink-jet recording head which is capable of providing high-density heaters of the electro-thermal conversion device board and ink ejection ports and a compact electro-thermal conversion device board, an ink-jet recording head provided with the electro-thermal conversion device board without deteriorating ink ejection performance.

Further, when making multi-value recording as described above, the bubble generation power is controlled by selectively changing the area of the driven electro-thermal conversion device. Therefore, the bubble generation power when forming a small liquid droplet is substantially small compared to a bubble generation power when only a single electro-thermal conversion device is disposed in one flow passage. In such a state, if there is a gap such that generates a crosstalk between flow passages, since a bubble generation power sufficient for ejection is difficult to be obtained because of an energy loss due to the crosstalk, there may be a case in which a desired liquid ejection cannot be made in a small liquid droplet ejection mode.

Here, it is also considered to increase the area of the electro-thermal conversion device used for ejecting small liquid droplets in order to reduce the effect of crosstalk, however, in this case, difference in ejection amount caused by respective combinations of a plurality of electro-thermal conversion devices in multi-value recording is decreased, which is not preferable.

Therefore, an ink-jet recording head in which a plurality of electro-thermal conversion devices are disposed in the flow passage for making multi-value recording is preferably provided on the board with a recess part engaging with a flow passage wall as described in Japanese Patent Application Laid-open No.7-89073 (1995) for the purpose of preventing crosstalk.

However, when flow passages are arranged in a high density in a construction in which a plurality of electro-thermal conversion devices are disposed in a single flow passage, it is difficult to form a sufficient depth of the recess part as has been performed in the past. That is, when the height of a discrete heat accumulation layer is increased to increase the depth of the recess part, wiring provided on top thereof (film formation of a wiring material in a stepped part) becomes difficult, resulting in deterioration of reliability. Further, it is also considered that the electro-thermal conversion device is disposed out of the recess part, however, decrease in width of wiring electrode has a certain limit since it results in an increase in wiring resistance and, since a plurality of electro-thermal conversion devices are provided in the flow passage which results in a increased number of wiring electrodes which is difficult to be achieved in a layout on a flat (two-dimensional) surface.

In consideration of the above problems, a second object of the present invention is to provide an electro-thermal conversion device board, an ink-jet recording head provided with the electro-thermal conversion device board, an ink-jet recording apparatus using the same and a production method of the ink-jet recording head which can provide a sufficient depth of a recess part for engaging with a flow passage wall and is superior in reliability of wiring electrodes.

SUMMARY OF THE INVENTION

In accordance with the present invention which attains the above objects, there is provided an electro-thermal conversion device board comprising electro-thermal conversion device layers having a plurality of heat generation parts arranged on a straight line corresponding to a plurality of liquid flow passages formed at one end side with liquid discharge ports for discharging a liquid used for recording, discrete electrode layers electrically connected respectively to the plurality of heat generation parts of the electro-thermal conversion device layer, common electrode layers formed stackedly through an insulation layer beneath the electro-thermal conversion device layers and the discrete electrode layers and electrically connected to the plurality of heat generation parts of the electro-thermal conversion devices, and a substrate part provided thereon with the electro-thermal conversion device layers, the discrete electrode layers and the common electrode layers.

The ink-jet recording head according to the present invention comprises a liquid discharge member having a plurality of liquid flow passages respectively formed at one end side with liquid discharge ports for discharging a liquid used for recording, electro-thermal conversion device layers having at one end side thereof a plurality of heat generation parts arranged on a straight line respectively corresponding to liquid flow passages provided with liquid discharge ports formed at one end side thereof for discharging a liquid used for recording, discrete electrode layers electrically connected respectively to the plurality of heat generation parts of the electro-thermal conversion device layers, common electrode layers formed in a stack through an insulation layer beneath the electro-thermal conversion device layers and the discrete electrode layers electrically connected respectively to the plurality of heat generation parts of the electro-thermal conversion devices, an electro-thermal conversion device board provided thereon with the electro-thermal conversion device layers, the discrete electrode layers and the common electrode layers, and a printed circuit board electrically connected to the electro-thermal conversion device board for supplying power respectively to the common electrode layers of the electro-thermal conversion device board.

The ink-jet recording apparatus according to the present invention comprises the above ink-jet recording head for performing recording operation to a recording surface of a recording medium, recording head moving means for moving the ink-jet recording head relative to the recording surface of the recording medium, and a control part for causing the recording head moving means to perform operation of relative movement of the ink-jet recording head and the ink-jet recording head to perform recording operation.

According to the present invention, since the common electrode layers are formed stackedly through an insulation layer beneath the electro-thermal conversion device layers having a plurality of heat generation parts arranged on a straight line corresponding to a plurality of liquid flow passages and discrete electrode layers and electrically connected respectively to the heat generation parts of the electro-thermal conversion device layers, high-density construction of heaters of the electro-thermal conversion device board and ink ejection ports and compact construction of the electro-thermal conversion device board can be achieved.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 4:
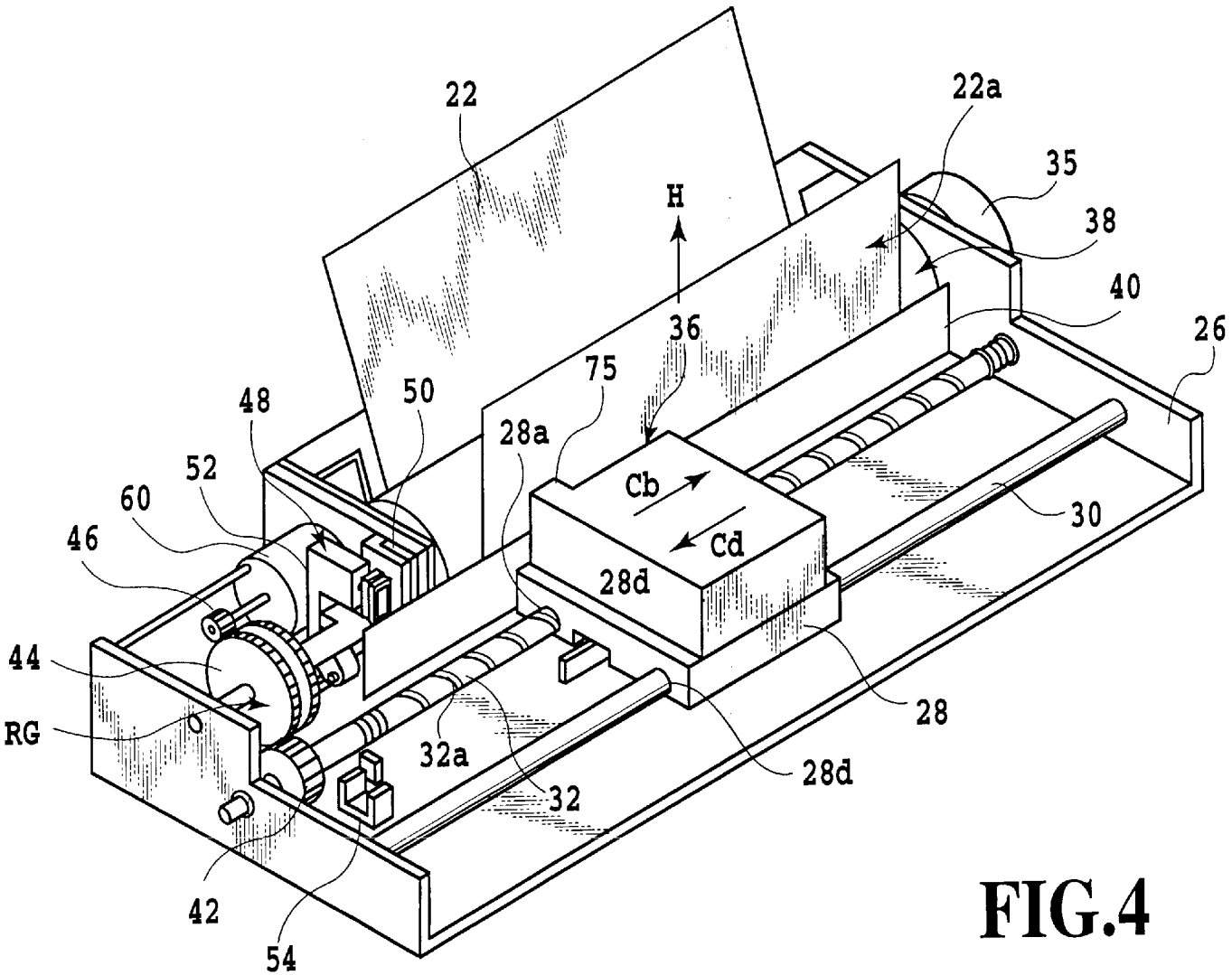
FIG. 4 is a perspective diagram showing schematic construction of a recording apparatus using an example of ink-jet recording head provided with the electro-thermal conversion device board according to the present invention.

FIG. 4 shows part of an example of ink-jet recording apparatus according to the present invention.

The apparatus shown in FIG. 4 comprises a guide shaft member 30 with its both ends supported on side wall parts of a casing 26 for guiding a carriage part 28, a lead screw member 32 with its both ends supported on side wall parts in almost parallel along the guide shaft member 30 for reciprocally moving the carriage part 28 along a scanning direction shown by an arrow Ca or Cb of FIG. 4, a carriage part 28 slidably supported on the guide shaft member 30 and engaged with the lead screw member 32 and selectively provided with an ink cartridge 36, a platen roller unit 38 disposed almost in parallel to the lead screw member 32 for transporting paper 22 as a recording medium in a sub-scanning direction perpendicular to the scanning direction of the carriage part 28, a paper transportation motor 35 connected to an end of the platen roller unit 38 for rotationally driving the platen roller unit 38, and a carriage drive motor 60 for rotationally driving the lead screw member 32 as main components.

The platen roller unit 38 comprises a pair of rollers which put the paper 22 between for transporting it, in which one of the rollers is connected to the paper transportation motor 35. A pressing plate 40 for pressing the recording surface 22*a* of the paper 22 to the platen roller unit 38 side is provided between the platen roller unit 38 and the carriage part 28. Consequently, when the paper transportation motor 35 is drive controlled according to a drive control signal from a control unit 106 which will be described later, the paper 22 is fed in the direction shown by an arrow H.

The lead screw member 32 has a spiral groove 32*a* which is engaged with an engage pin provided in an engaging hole 28*a* of the carriage part 28. At an end of the lead screw member 32, a gear 42 of a reduction mechanism RG is provided. The reduction mechanism RG comprises the gear 42 fixed at an end of the lead screw member 32, a gear 44 which is engaged with the gear 42 and has a greater module than the gear 42, and a gear 46 engaged with the gear 44. The gear 46 is connected to an output shaft of the carriage drive motor 60. With this construction, when the carriage drive motor 60 is drive controlled according to a drive control signal from a control unit 106 which will be described later, the lead screw member 32 is rotated in a forward or reverse direction through the reduction mechanism RG, and the carriage part 28 is reciprocally moved along a scanning direction.

In the peripheral part of the carriage drive motor 60 and the reduction mechanism RG, a recovery processing apparatus 48 is provided, which, when the carriage part 28 is at a predetermined home position (stand-by position), is opposed to a plurality of ink ejection ports of a recording head 75 of the ink cartridge 36 mounted to the carriage 28 for performing suction recovery processing of the recording head 75. Further, between the recovery processing apparatus 48 and the platen roller unit 38, there are provided a cleaning blade 50 for wiping stain on the ink ejection port formation surface of the recording head when the ink cartridge 36 mounted on the carriage 28 is moved, and a support moving member 52 for supporting the cleaning blade 50 and moving the cleaning blade 50 towards the ink ejection port formation surface of the recording head according to a movement timing of the recording head 75. The support moving member 52 is moved by a drive part communicated with the carriage drive motor 60.

Still further, at the predetermined home position between the lead screw member 32 and the guide shaft member 30, there is provided a home position detection part 54 which detects that a lever member 28*d* provided on a bottom of the carriage part 28 is at the home position. The home position detection part 54 is, for example, a photocoupler which outputs a detection output signal to the control unit 106.

The carriage part 28, when the carriage drive motor 60 is in operation, is slidably supported by the guide shaft member 30 engaged with its engaging hole 28*b* and the lead screw member 32 engaged with its engaging hole 28*a,* to be reciprocally moved by a predetermined moving amount.

Figure 5:
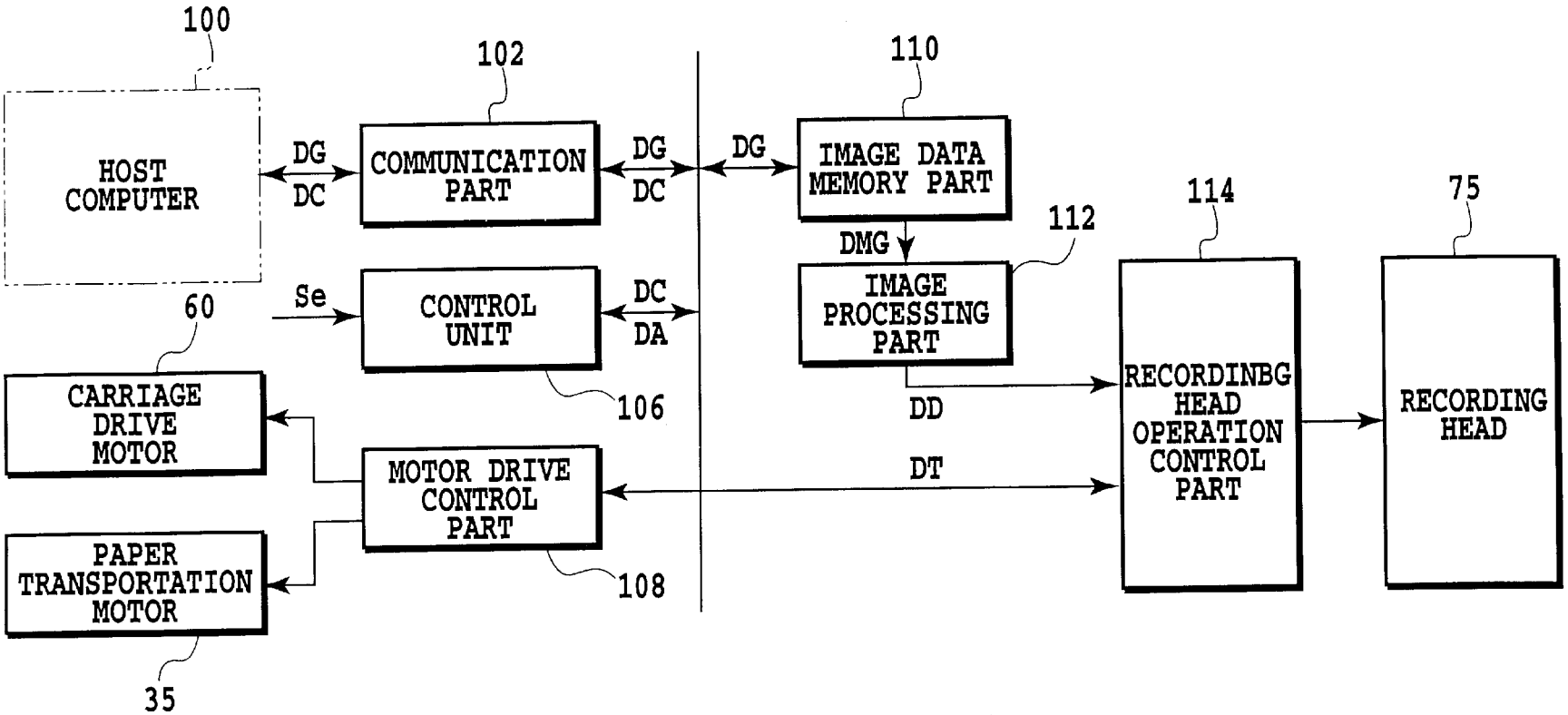
FIG. 5 is a block diagram showing the construction of a control block provided in the example shown in FIG. 4.

Yet further, in an example of ink-jet recording apparatus according to the present invention, in addition to the above, as shown in FIG. 5, there is provided a control block comprising a recording head operation control part 114 for performing operation control of the recording head.

The control block comprises, as main components, a communication part 102 supplied with image data DG and control data DC from a host computer 100 disposed separately from the ink-jet recording apparatus, an image data memory part 110 for selectively storing image data DG transferred from the communication part 102 and selectively outputting the stored image data DG, an image processing part 112 for performing data conversion processing to image data DMG read from the image data memory part 110 to obtain recording operation control data DD, and a control unit 106 for performing operation control of the image data memory part 110 through a transmission path 104, the image processing part 112, the motor drive control part 108, and the recording head operation control part 114.

The communication part 102 comprises, for example, an interface circuit (IEEE 1284), which is in a reception state when supplied with image data DG and control data DC of one scan or a predetermined number of scans from the host computer 100. Further, the communication part 102 is in a transmission state when supplied with a data representing a storage capacity of he image data memory part 110 from the control unit 106, to output the data to the host computer 100.

The control unit 106 supplies control data group DM, to the motor drive control part 108 according to control data DC obtained through the transmission path 104, for causing the carriage drive motor 60 and the paper transportation motor 35 to perform a predetermined operation. Further, the control unit 106 forms discharge timing data DT of the recording head 75 synchronizing with movement of the carriage part 28 according to a detection output signal Se from an encoder part provided in the carriage part 28, and outputs it.

The motor drive control part 108, to reciprocate the carriage part by a predetermined distance, forms a drive control signal according to the control data group DM, supplies the signal to the carriage drive motor 60 and, to transport paper Pa intermittently by a predetermined distance according to the recording operation of the recording head 75, forms a drive control signal according to the control data group DM, and supplies the signal to the paper transportation motor 35.

The image data memory part 110, for example, in a mode of a predetermined number of bits per pixel, is written successively with supplied image data DG to each designated memory address, and the image data memory part 110 supplies image data DMG of every one scan stored in the designated memory address to the image processing part 112.

The image processing part 112 comprises a multi-value/binary conversion part for performing binarization processing to, for example, image data DMG from the image data memory part 110, a signal distribution processing part for distributing the binarized data from the multi-value/binary conversion part to the recording head 75, and a registration adjustment part for performing raster BJ conversion to coincide the arrangement of the binarized data distributed from the signal distribution processing part with the arrangement of the discharge ports of the recording head 75 and performing registration adjustment, and outputting recording operation control data group DD to the recording head operation control part 114.

The recording head operation control part 114, when the recording head 75 and the carriage part 28 are moved, to cause the recording head 75 to perform recording operation, forms a drive control pulse signal group PB synchronized with discharge timing data DT from the control unit 106, and supplies respective signals to the recording head 75.

Thus, the recording head 75 performs recording operation to the recording surface of paper Pa.

Figure 3:
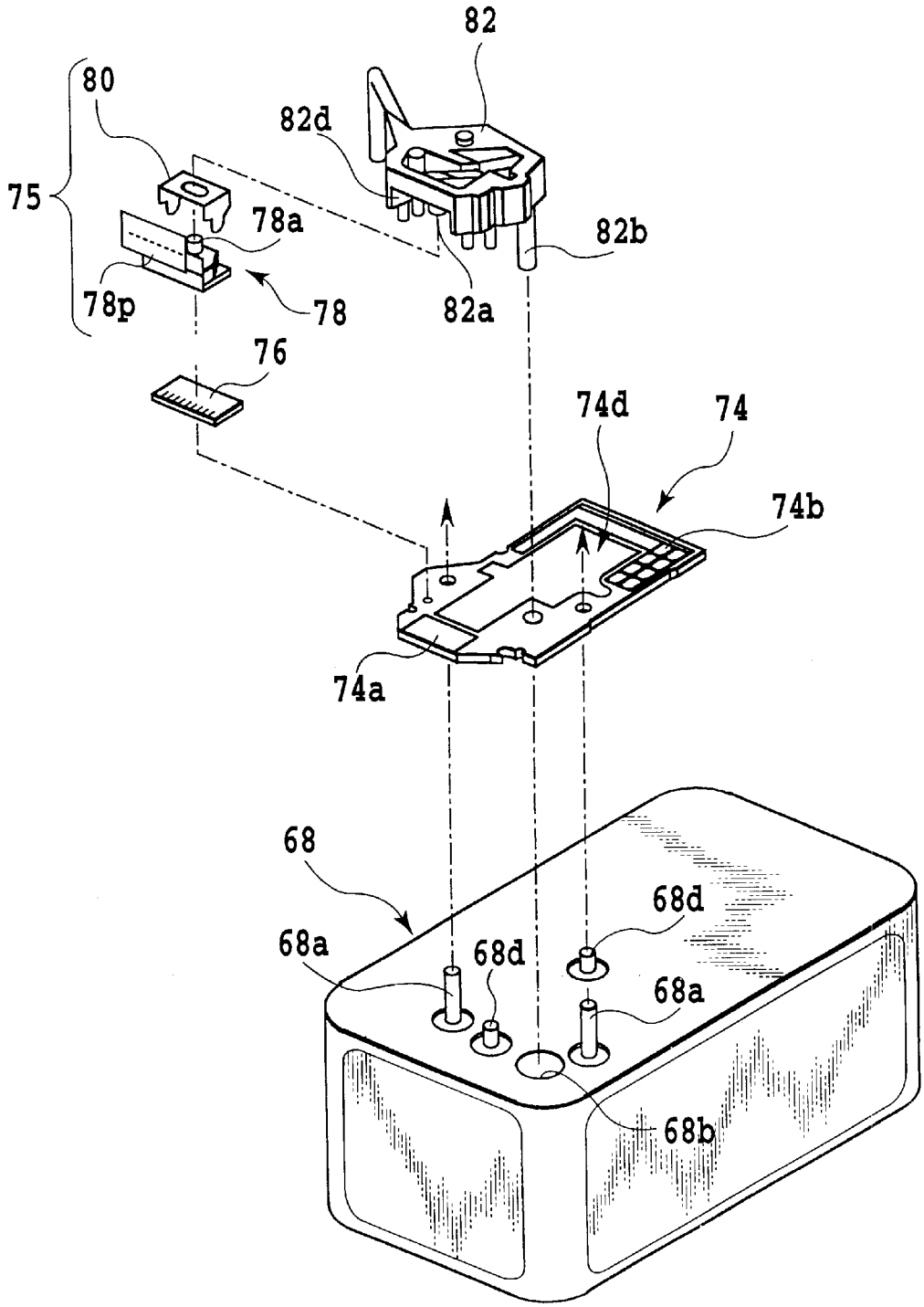
FIG. 3 is an exploded perspective diagram showing an example of ink-jet recording head provided with the electro-thermal conversion device board according to the present invention.

The recording head 75 of the ink cartridge 36, as shown, for example, in FIG. 3, comprises an electro-thermal conversion device board 76 which is an example of the electro-thermal conversion device board according to the present invention, an ink ejection member 78, a pressing spring 80 for pressing the ink ejection member 78 towards the electro-thermal conversion device board 76, an ink supply distribution member 82 for supplying and distributing ink to the ink ejection member 78, and a printed circuit board 74, as main components.

The printed circuit board 74 has an electrode surface part 74*a* for fixing the electro-thermal conversion device board 76, a circuit part 74*d* electrically connected to the electrode surface part 74*a* for outputting a drive control signal group, and a contact pad 74*b* electrically connected with the circuit part 74*d* for outputting the drive control signal group to the circuit part 74*d*.

The printed circuit board 74, by inserting a pair of fixing shafts 68*a* provided on an end surface of an ink tank 68 which will be described later into through holes through a connection member (not shown), is fixed on an end surface of the ink tank 68. Further, the printed circuit board 74 is positioned on an end surface of the ink tank 68 by engaging the connection member with a pair of positioning members 68*d* provided on the end surface of the ink tank 68. The contact pad 74*b* is connected to an end of a flexible cable (not shown). The flexible cable supplies the control signal group from the control unit 106 to the contact pad 74*b*.

The ink supply distribution member 82 has a through hole of the printed circuit board, a supply passage 82*b* connected to a supply passage 68*b* of the ink tank 68 through the through hole of the connection member, and a supply passage 82*a* communicating with the supply passage 82*b* through the inside and connected to a connection part 78*a* of the ink ejection member 78 Further, the ink supply distribution member 82 has an engaging part 82*d* holding an edge part of the ink ejection port formation surface between of the ink ejection member 78 cooperatively with the pressing spring 80 and the electro-thermal conversion device board 76, at a position corresponding to the electrode surface 74*a* of the printed circuit board 74.

The ink ejection member 78 has a common liquid chamber communicating with the connection part 78*a* connected to the supply passage 82*a* of the ink supply distribution member 82. The common liquid chamber has a volume for storing a predetermined amount of ink and communicates respectively with one end of a plurality of ink flow passages.

Figure 1A:
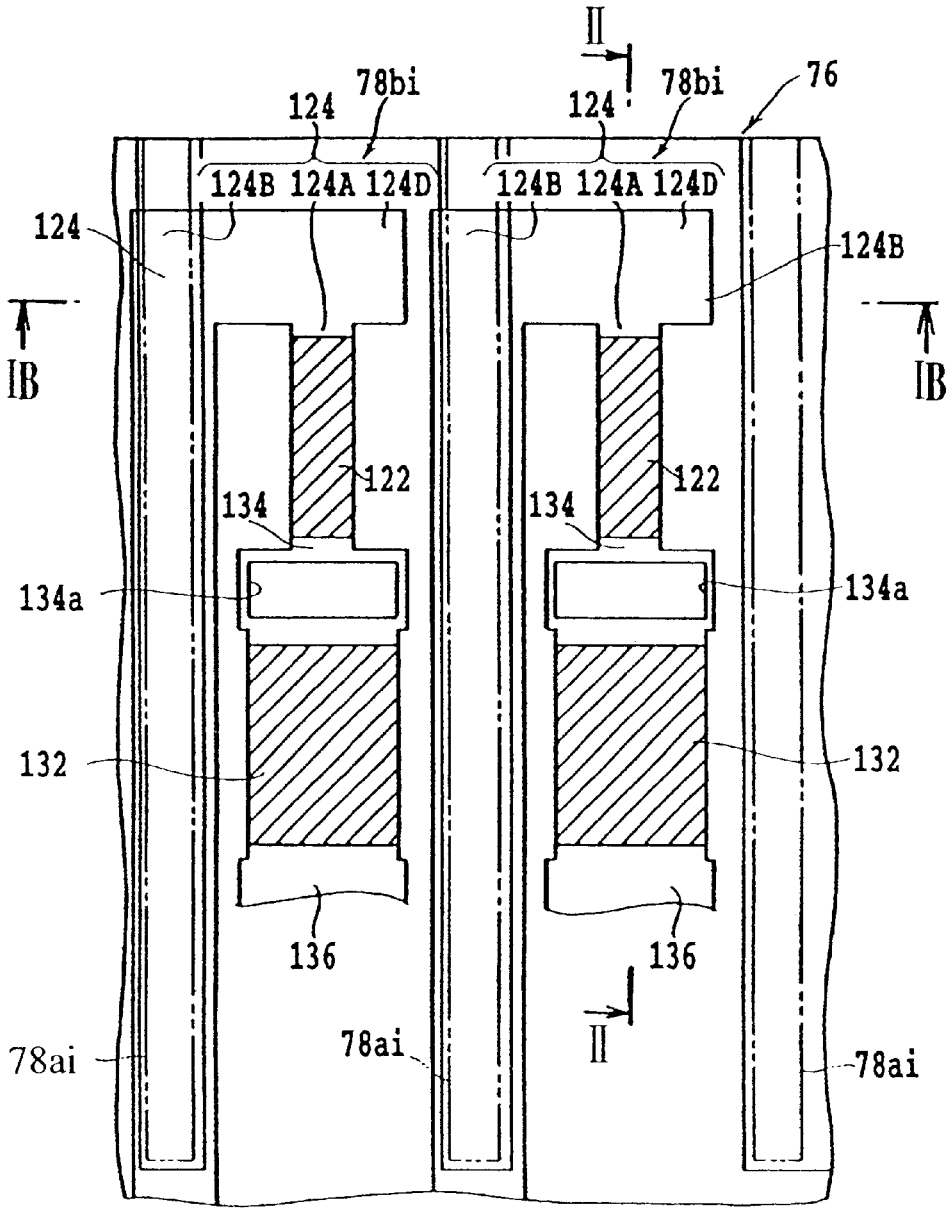
FIG. 1A is a plane diagram showing part of an first embodiment of electro-thermal conversion device board according to the present invention.
Figure 1B:
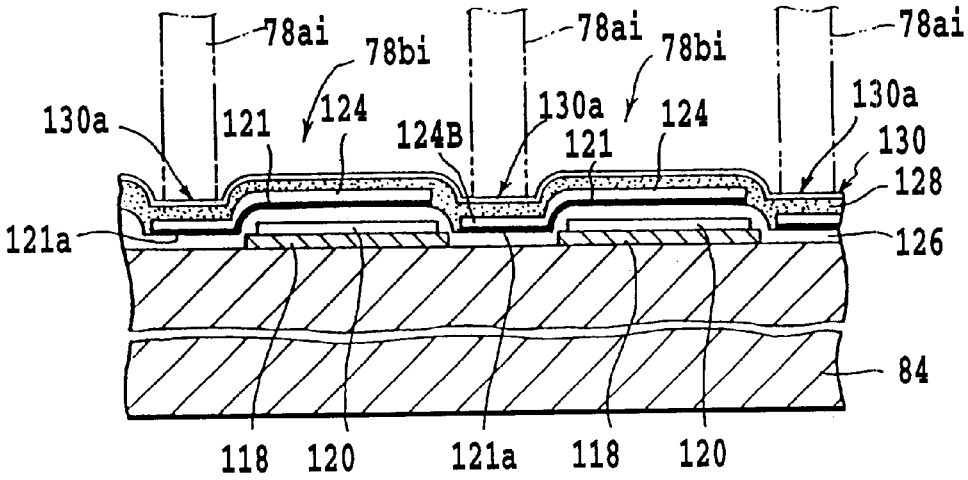
FIG. 1B is a partial sectional diagram taken along line 1B—1B in FIG. 1A.

Each ink flow passage 78*bi* (i=1 to n, n is an integer), as shown in FIG. 1B, is formed in parallel to each other by two partition wall members 78*ai* (i=1 to n, n is an integer) provided in opposite at the position opposing the electro-thermal conversion device board 76 in the ink ejection member 78 and the electro-thermal conversion device board 76.

An ink ejection port is formed at the other end of each ink flow passage 78*bi*. The ink ejection ports are formed and arranged on a straight line at a predetermined interval on the ink ejection port formation surface 78*b* of the ink ejection member 78.

FIGS. 1A and 1B show a first embodiment of the electro-thermal conversion device board according to the present invention.

The electro-thermal conversion device board 76, as shown in FIGS. 1A and 1B, comprises a base table part 84, an insulation layer 118 as a heat accumulation layer disposed corresponding to each ink flow passage 78*bi* on one end surface of the base table part 84, a common electrode layer 134 (120) placed on the insulation layer 118, heaters 122 and 132 as electro-thermal conversion devices in the electro-thermal conversion device layer (heat generation resistor layer) 121 disposed on the common electrode layer 134(120) through a protective layer 126, discrete electrode layers 124 and 136 with one end connected to the heaters 122 and 132, and a cavitation resistant layer 130 covering the heaters 122 and 132, the common electrode layer 134(120), the discrete electrode layers 124 and 136 through the protective layer 128. In FIGS. 1A and 1B, parts corresponding to part of the plurality of ink flow passage 78*bi* are shown representatively. and other parts are omitted.

The base table part 84 is formed, for example, of a single-crystal silicon material with a predetermined thickness.

Each insulation layer 118 is, for example, silicon oxide which is formed at a position corresponding to each ink flow passage 78*bi*. Each insulation layer 118 is formed by a thermal oxidation method, a sputtering method, or a CVD method to a film thickness of about 1.8 ($\mu$m). Spacing between adjacent insulation layers 118 is set to a distance slightly greater than the thickness of the partition wall member 78*ai*.

For example, the common electrode layer 134 made of aluminum in a film thickness of about 5100 (angstrom) is formed nearly at the center of the portion corresponding to the ink flow passage 78*bi*. End part of the ink ejection port side in the common electrode layer 134, as shown in FIG. 2, is extended to a position beneath the discrete electrode 124.

Between the discrete electrode 124 and the discrete electrode 136 in the common electrode layer 134, a branch connection part 134A having a hole 134*a* is formed nearly at the center thereof. With this construction, power supplied through the common electrode layer 134 is supplied to the heaters 122 and 132 which will be described later through the branch connection part 134A.

Both ends in width direction of the ink flow passage 78*bi* of the common electrode layer 134 oppose to the partition wall members 78*ai* at a predetermined spacing. The common electrode layer 134, after being formed in a predetermined film thickness 5100 (angstrom) by a sputtering method, is formed by dry etching with a mixed gas ($BCl_3$, $Cl_2$, $N_2$). Mixing ratios of respective gases of the mixed gas are, for example, 46, 36 and 18 (%), respectively.

Figure 2:
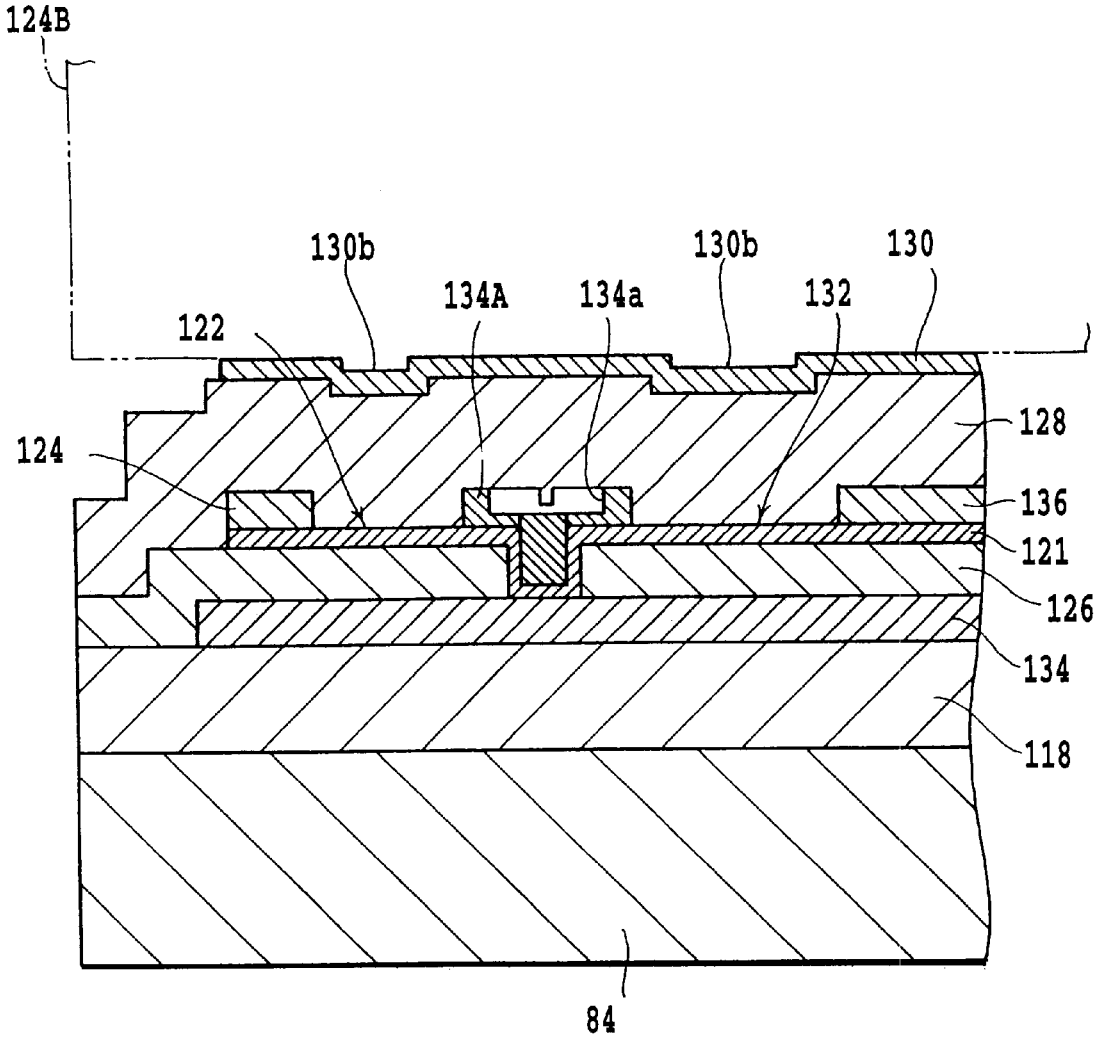
FIG. 2 is a partial sectional diagram taken along II—II in FIG. 1A.

The common electrode layer 134, as shown in FIG. 2, is covered with a protective layer 126 as an insulation film. The protective layer 126 is formed, for example, of silicon oxide in a thickness of about 1.2 ($\mu$m). The hole 134*a* of the branch connection part 134A is formed by etching using, for example, ammonium fluoride.

The electro-thermal conversion device layer 121 is formed in the form of a thin film using, for example, a target material of tantalum and silicon alloy by a reactive sputtering method. The heaters 122 and 132 of the electro-thermal conversion device layer 121 are respectively disposed on a common straight line on the base table part 84 putting the branch connection part 134A of the common electrode layer 134 between with a predetermined spacing. The heaters 122 and 132, as shown in FIG. 1B, have extension parts 122*a* and 132*a* extended to the parts corresponding to the parts between two adjacent insulation layers 118.

In this case, the heater 122 is disposed closer to the ink ejection port side than the heat generation part 132 in the ink flow passage 78*bi*. Further, heat generation amount of the heater is smaller than that of the heat generation part 132.

The discrete electrode layer 124 connected to one side of the heater 122 and the discrete electrode layer 136 connected to one side of the heat generation part 132, as shown in FIG. 2, are respectively formed of, for example, aluminum in the form of thin films on a same plane on the top surface of the electro-thermal conversion device layer 121, together with the branch connection part 134A of the common electrode layer 134.

The discrete electrode layer 124, as shown in FIG. 1A, has a connection part 124A connected to an end of the heater 122, an extension part 124D expanding from the connection part 124A to the adjacent partition wall member 78*ai* and the vicinity of other discrete electrodes 124, and a connection part 124B connecting to the connection part 124A oppositely to the extension part 124D and bending and extending along the ink flow passage 78*bi* on the top surface of the extension part 122*a* of the heater 122.

The thickness direction position of the connection part 124B of the discrete electrode layer 124, as shown in FIG. 1B, is lower than the position of the connection part 124A and the extension part 124D. Further, between the connection part 124B of the discrete electrode layer 124 and the extension part 124D of other discrete electrode layers 124 adjacent to each other, a step having a predetermined height is formed. Further, the other end of the connection part 124B is connected to a predetermined terminal part.

The discrete electrode layer 136 has a connection part connected to the heat generation part 132. The connection part has the same width as the width in the ink ejection port arranging direction of the heat generation part 132.

The common electrode layer 134, the discrete electrode layer 124 and the discrete electrode layer 136, heaters 122 and 132 in each ink flow passage 78*bi* are covered with a common protective layer 128.

The protective layer 128 is formed, for example, of silicon nitride or silicon oxide in a thickness of about 1.0 ($\mu$m) by a plasma CVD method.

The cavitation resistant layer 130 covering a greater part of the protective layer 128 is formed of, for example, tantalum in a thickness of about 2300 (angstrom) by a sputtering method.

Further, the cavitation resistant layer 130 has a relatively shallow recess part 130*b* at a position corresponding to the part between the branch connection part 134A and the discrete electrode layer 124 and discrete electrode layer 136, corresponding to each ink flow passage 78*bi*. Still further, between respective adjacent inkflow passages 78*bi,* a recess 130*a* for regulating the partition wall member 78*ai* position relative to common electrode layer 134 (common electrode layer 120), the discrete electrode layer 124 and discrete electrode layer 136 are formed corresponding to the partition wall member 78*ai.* The common electrode layer 120, as will be described later, is electrically connected to the other end part of the common electrode layer 134. The recess 130*a* has, for example, a depth of about 1.0 ($\mu$m) and a width corresponding to the thickness of the partition wall member 78*ai.* Therefore, since, in a state in which the lower end surface of each partition wall member 78*ai* of the ink ejection member 78 closely engaged securely with bottom part of the recess 130*a* of the electro-thermal conversion device board 76, the ink ejection member 78 and the electro-thermal conversion device board 76 are assembled, ink leakage between respective ink flow passages 78*bi* is certainly prevented.

As described above, since the common electrode layer 134, the discrete electrode layers 124 and 136 are disposed in a multilayered construction, sharing area of each electrode layer corresponding to each ink flow passage 78*bi* becomes small and, therefore, the distance between adjacent respective ink flow passages 78*bi* is reduced, thereby enabling high-density construction of the ink ejection ports.

Yet further, when forming the above-described branch connection part 134A, and the discrete electrode layers 124 and 136, after the electro-thermal conversion device layer 121 is first formed on the protective layer 126, a thin film of aluminum is formed in a thickness of 5500 (angstrom) on the electro-thermal conversion device layer 121 by a sputtering method.

Next, after an unnecessary part of the electro-thermal conversion device layer 121 and its thin film is depicted by patterning processing of a photolithography method, the unnecessary part is removed by a predetermined etching process. Then, the parts of the remained thin film opposing the heaters 122 and 132 in the electro-thermal conversion device layer 121, the outer peripheral part of the discrete electrode layer 124 and 136 are removed by etching process according to a predetermined patterning, thereby forming the branch connection part 134A, and discrete electrode layers 124 and 136.

Figure 6A:
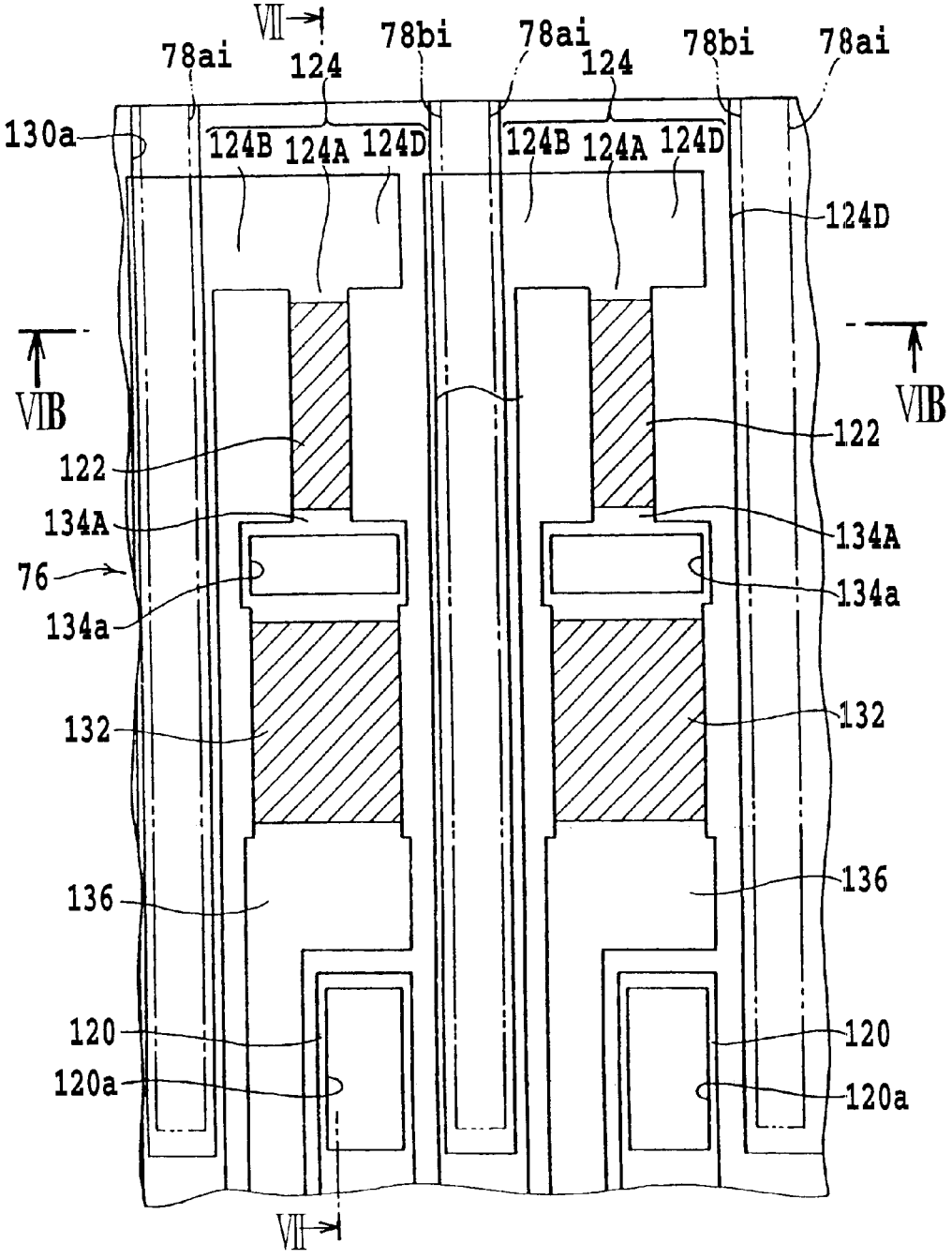
FIG. 6A is a plane diagram showing part of a second embodiment of the electro-thermal conversion device board according to the present invention.
Figure 6B:
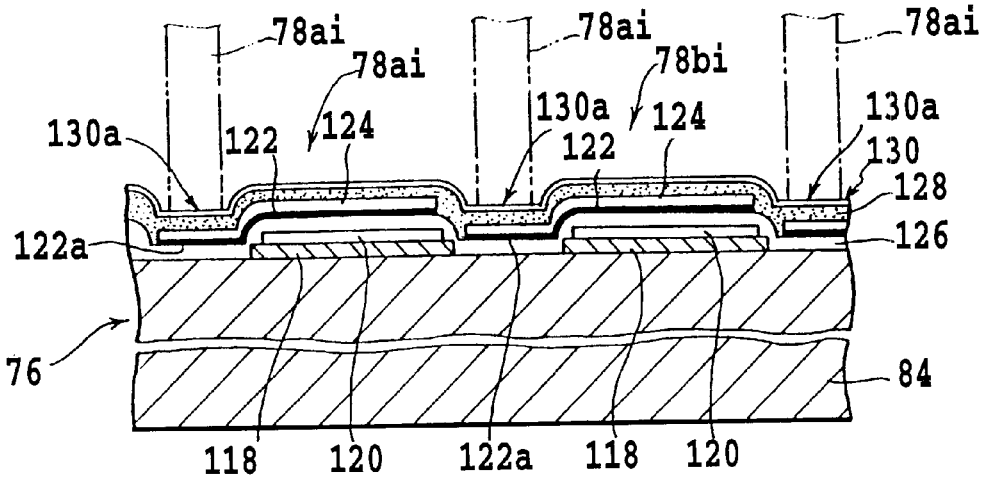
FIG. 6B is a partial sectional diagram taken along line VIB—VIB in FIG. 6A.
Figure 7:
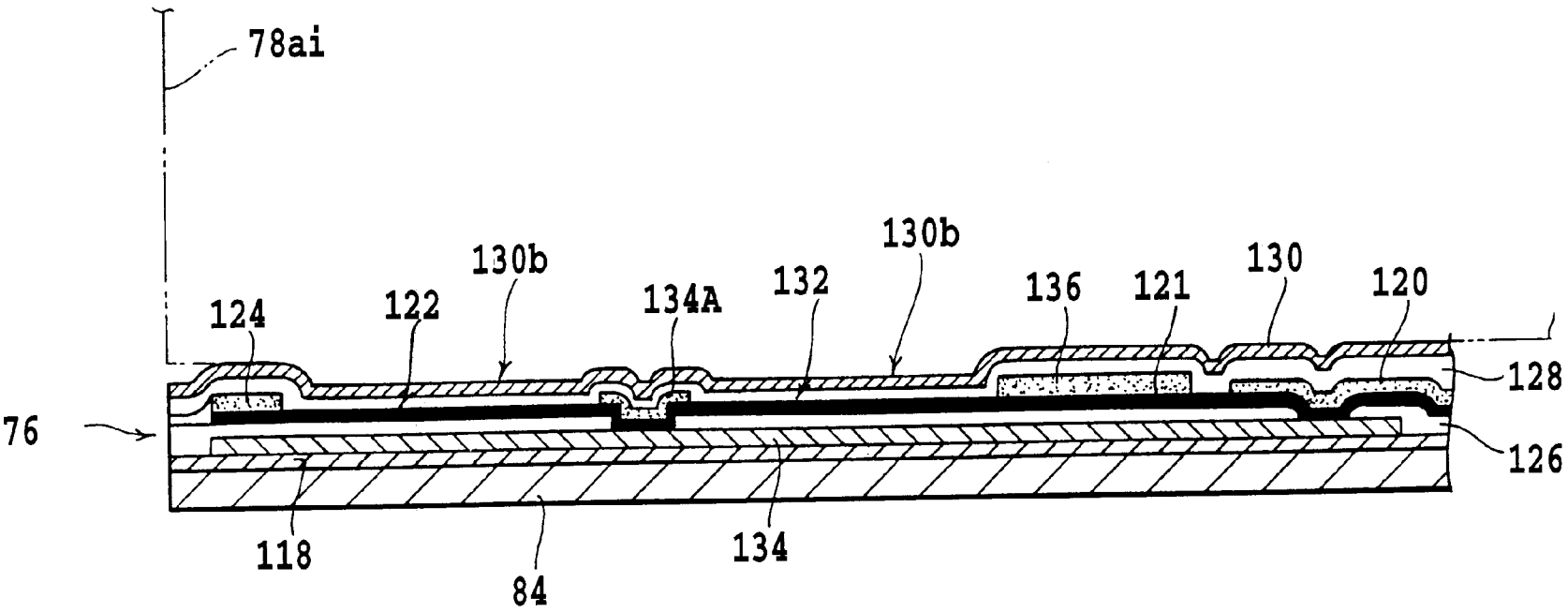
FIG. 7 is a partial sectional diagram taken along line VII—VII of the ink-jet recording head in FIG. 6A.

FIGS. 6A, 6B and 7 show a second embodiment of the electro-thermal conversion device board according to the present invention. In FIGS. 6 and 7, same parts as used in the example shown in FIGS. 1A and 1B are indicated with the same symbols, and detailed description thereof is omitted.

In FIGS. 6A, 6B and 7, the common electrode layer 134 is covered with the protective layer 126 as an insulation film. Further, space between adjacent common electrode layer 134 and insulation layer 118 is also covered with the protective layer 126.

The common electrode layer connection part 120 formed adjacent to the connection part of the discrete electrode layer 136, as shown in FIG. 6A, has a hole 120*a*. The common electrode layer connection part 120 is connected to a power supply layer for supplying a predetermined power. This supplies a predetermined power to the common electrode layer connection part 120 through the power supply layer. The size in the width direction of the ink flow passage 78*bi* in the common electrode layer connection part 120 is smaller compared to the width of the connection part of the discrete electrode layer 136 and the width of the electro-thermal conversion device 132.

Figure 9A:
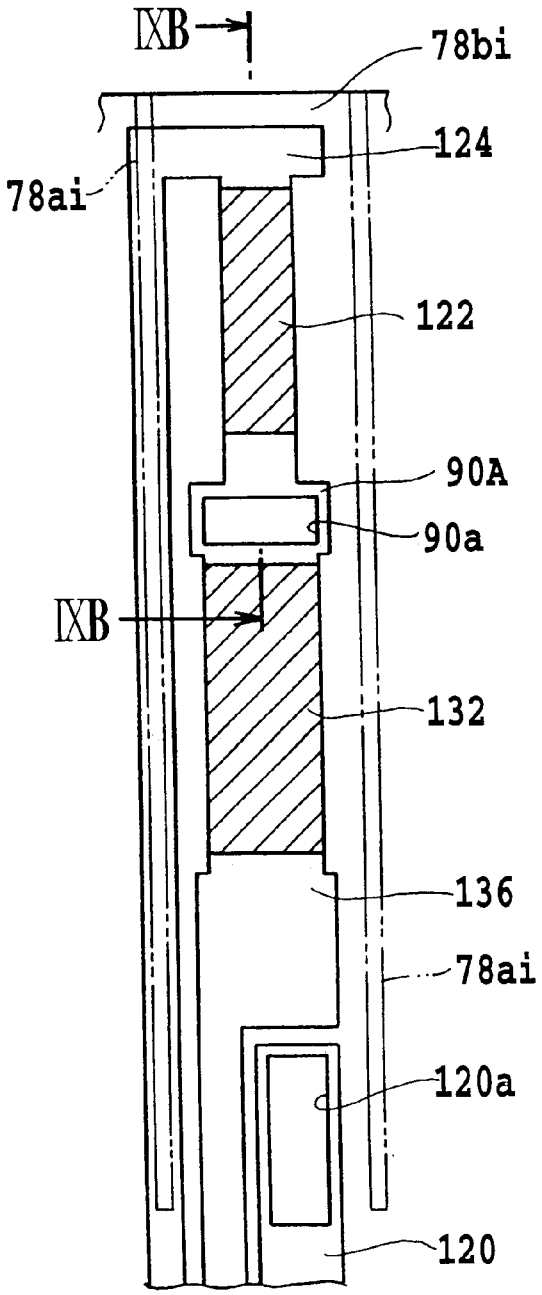
FIG. 9A is a plane diagram used for technical explanation related to an example of the electro-thermal conversion device board according to the present invention.
Figure 9B:
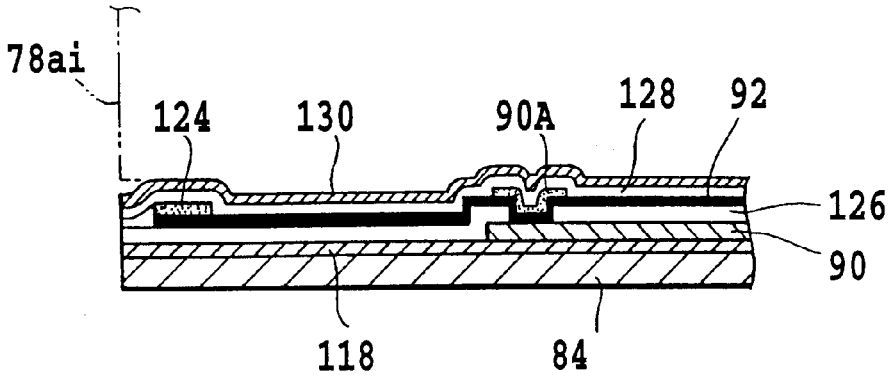
FIG. 9B is a partial sectional diagram taken along line IXB—IXB in FIG. 9A.

On the other hand, in the electro-thermal conversion device board, as shown in FIGS. 9A and 9B, there may be a case in which one end at the ink ejection port side of the common electrode layer 90 is formed only to a position beneath the vicinity of branch connection part 90A on the heat generation resistor layer 92. In FIGS. 9A and 9B, same parts as used in FIGS. 6A and 6B and FIG. 7 are indicated with the same symbols and detailed description thereof is omitted.

In such a case, there is a fear that a step is produced in the vicinity of the branch connection part 90A between the protective layer 128 and the heat generation resistor layer 92 formed from the vicinity of the branch connection part 90A towards the ink ejection port side and the protective layer 128 and the heat generation resistor layer 92 formed from the vicinity of the branch connection part 90A towards the common electrode layer connection part 120 side. If such a step is formed, there may be a case in which a thermal stress and stress concentration exert on that part.

However, as shown in FIGS. 6A, 6B and 7,in an example of electro-thermal conversion device board according to the present invention, since the end part of the ink ejection port side in the common electrode layer 134 is extended to beneath the discrete electrode layer 124, occurrence of such a problem is prevented, and the distance between the electro-thermal conversion device 122 and the electro-thermal conversion device 132 is reduced.

In the production of the above-described electro-thermal conversion device board 76, as shown in FIGS. 8A to 8D, after the above insulation layer 118 is first formed on the base table part 84 made of silicon material, the common electrode layer 94 is formed of aluminum material on the insulation layer 118 by a sputtering method.

FIGS. 8A to 8D schematically show part corresponding to one ink flow passage 78*bi* in the above-described base table part 84 and the heat generation resistor layer 121.

Next, after a common electrode layer is further formed on the common electrode layer 94 by above dry etching, on the top surface thereof, the insulation layer 95 is formed by a plasma CVD method. At this moment, as shown in FIG. 8B,holes 95*a* and 95*b* are formed by etching at positions corresponding to the hole 134*a* of the above branch connection part 134A and the hole 120*a* of the common electrode layer connection part 120.

Figure 8A:
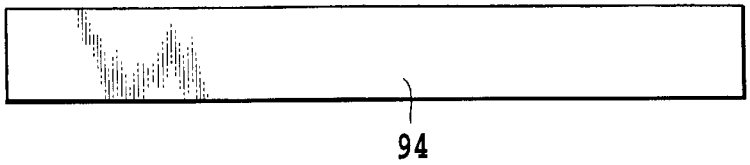
FIGS. 8A, 8B, 8C and 8D are diagrams for explaining the production methods in a second embodiment of the electro-thermal conversion device board according to the present invention.
Figure 8B:
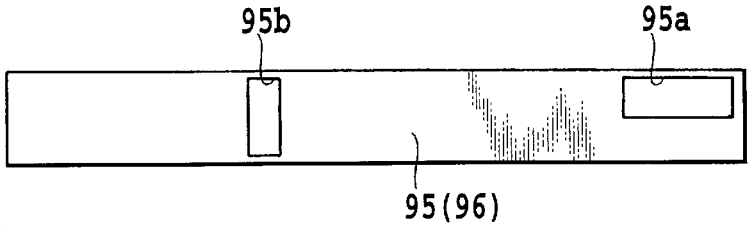

Next, as shown in FIG. 8B, a heat generation resistor layer 96 made of Ta—SiN(tantalum and silicon nitride) is formed on the insulation layer 95 by the above-described reactive sputtering method.

Figure 8C:
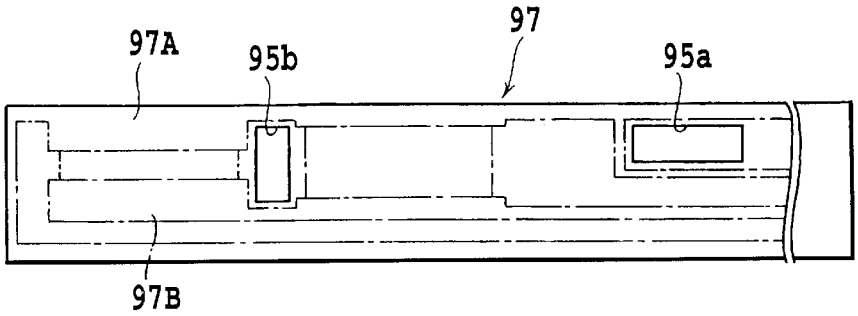

Next, an electrode layer 97 made of aluminum, as shown in FIG. 8C, is formed on the heat generation resistor layer 96 in a thickness of 5500 (angstrom) by a sputtering method.

Figure 8D:
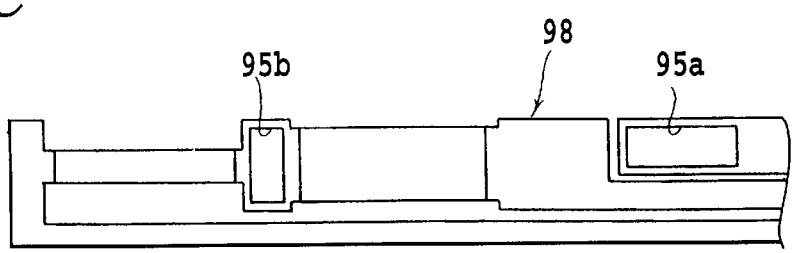

Next, after unnecessary parts 97A and 97B in the heat generation resistor layer 96 and the electrode layer 97 are formed by photolithographic patterning, as shown in FIG. 8C, the unnecessary parts 97A and 97B are removed by a predetermined etching processing as shown in FIG. 8D.

Next, by removing the part opposing each electro-thermal conversion device of the heat generation resistor layer 96 in the remained electrode layer 98 by etching of predetermined patterning, the branch connection part 134A, discrete electrode layers 124 and 136 shown in FIG. 6A are formed.

Then, by forming the protective layer 128 and the cavitation resistant layer 130 on the electrode layer 98 respectively by a plasma CVD method and a sputtering method, the above-described electro-thermal conversion device board 76 is obtained.

Figure 10A:
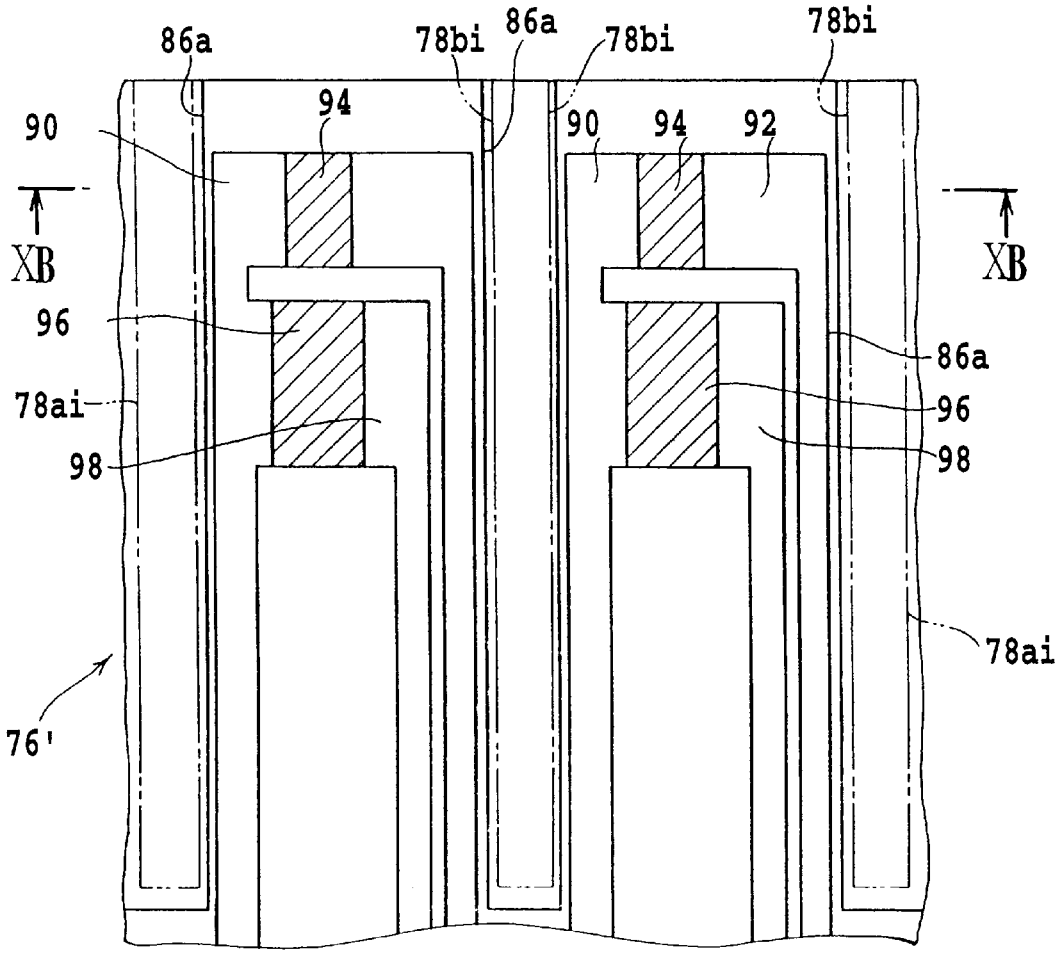
FIG. 10A is a partial sectional diagram showing part of a third embodiment of the electro-thermal conversion device board according to the present invention.
Figure 10B:
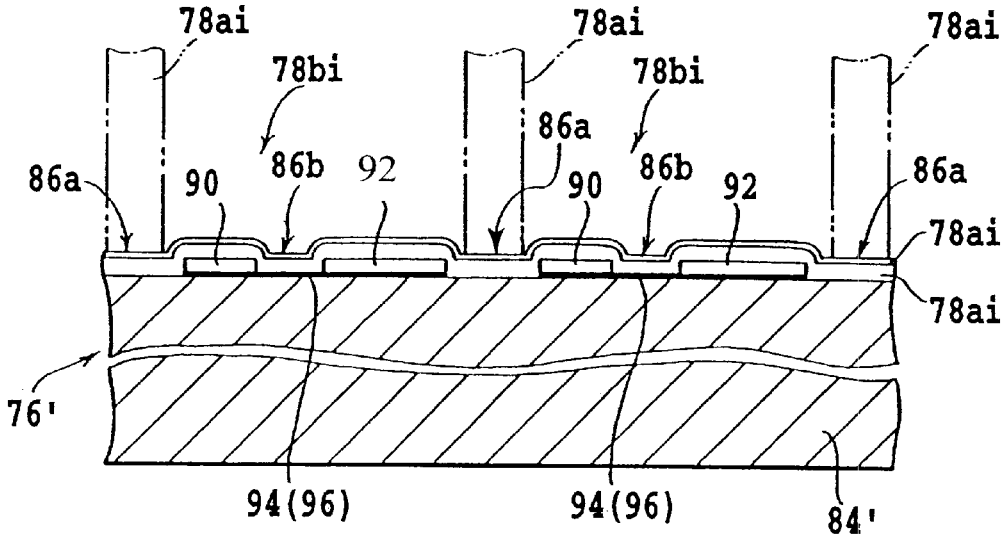
FIG. 10B is a partial sectional diagram taken along line XB—XB in FIG. 10A.

An electro-thermal conversion device board 76' in a third embodiment of the electro-thermal conversion device board according to the present invention, as shown in FIGS. 10A and 10B, comprises, for example, a base table part 84' made of silicon and fixed to the electrode surface 74*a* of the printed circuit board 74, heaters 94 and 96 as electro-thermal conversion devices disposed corresponding to each ink flow passage 78*bi* on one end surface of the base table part 84', a common electrode layer 90 connected to the heaters 94 and 96 for supplying power, respectively, discrete electrode layers 92 and 98 with respective ends connected to the heaters 94 and 96, and a cavitation layer 86 for covering the heaters 94 and 96, the common electrode layer 90,the discrete electrode layers 92 and 98 through the protective layer 88. In FIGS. 10A and 10B, the part corresponding to part of a plurality of ink flow passages 78*bi* is shown representatively, and other parts are omitted.

The nearly rectangular base table part 84 is formed, for example, in a thin film with a thickness of about 625 ($\mu$m). Further, on its surface layer, for example, a heat accumulation layer (not shown) comprising an electrical insulation material such as silicon oxide having a predetermined thickness is formed.

The heaters 94 and 96 as electro-thermal conversion devices are formed of, for example, $HfB_2$ (hafnium boride), and disposed so that the central axis line coincides with a common central axis line on the base table part 84 at a predetermined spacing. In this case, the heaters 94 and 96 are part of the heat generation layer formed along the ink flow passage 78*bi* with a predetermined width on the base table part 84. The heater 94 is disposed closer to the ink ejection port side than the heater 96 in the ink flow passage 78*bi*. Heat generation amount of the heater 94 is small than that of the heater 96.

The discrete electrode layer 92 connected to one side of the heater 94 and the discrete electrode layer 98 connected to one side of the heater 96 are formed of, for example, aluminum in thicknesses of about 0.2 to 1.0 ($\mu$m). The other end sides of the discrete electrode layer 92 and the discrete electrode layer 98 are disposed in juxtaposition at a predetermined spacing along the ink flow passage 78*bi*.

The common electrode layer 90 connected to the other side of the heaters 94 and 96 is formed of the same material and in the same thickness as the discrete electrode layer 92 and the discrete electrode layer 98 in nearly parallel to the discrete electrode layers 92 and 98 along the ink flow passage 78*bi*. The common electrode layer 90, the discrete electrode layer 92 and the discrete electrode layer 98 are opposed to each other on the same plane and separated by a predetermined distance.

Further, between adjacent ink flow passages 78*bi*, the common electrode layer 90 of one ink flow passage 78*bi* and the discrete electrode layer 92 and the discrete electrode layer 98 of the other ink flow passage 78*bi* is separated by a distance corresponding to the thickness of the partition wall member 78*bi*.

The common electrode layer 90, the discrete electrode layer 92 and the discrete electrode layer 98, and the heaters 94 and 96 in each ink flow passage 78*bi* are covered with a common protective layer 88.

The protective layer 88 is formed of, for example, silicon nitride or silicon oxide in a thickness of about 1.0 ($\mu$m).

The cavitation resistant layer 86 is formed of, for example, tantalum in a thickness of about 0.2 ($\mu$m). Further, the cavitation resistant layer 86 has a relatively shallow recess 86b at a position corresponding to the part between the common electrode layer 90 corresponding to each ink flow passage 78*bi* and the discrete electrode layer 92 and the discrete electrode layer 98. Still further, between adjacent ink flow passages 78*bi*, a recess 86*a* for regulating the relative position to the common electrode layer 90, the discrete electrode layer 92 and the discrete electrode layer 98 of the partition wall member 78*ai*, is formed corresponding to the partition wall member 78*ai*. The recess 86*a* has, for example, a depth of about 1.0 ($\mu$m) and a width corresponding to the thickness of the partition wall member 78*ai*.

Therefore, since, with the lower end surface of each partition wall member 78*ai* of the ink ejection member 78 securely engaged with the bottom of the recess 86*a* of the electro-thermal conversion device board 76, the ink ejection member 78 and the electro-thermal conversion device board 76 are assembled, ink leakage between respective ink flow passages 78*bi* is certainly prevented.

Figure 11A:
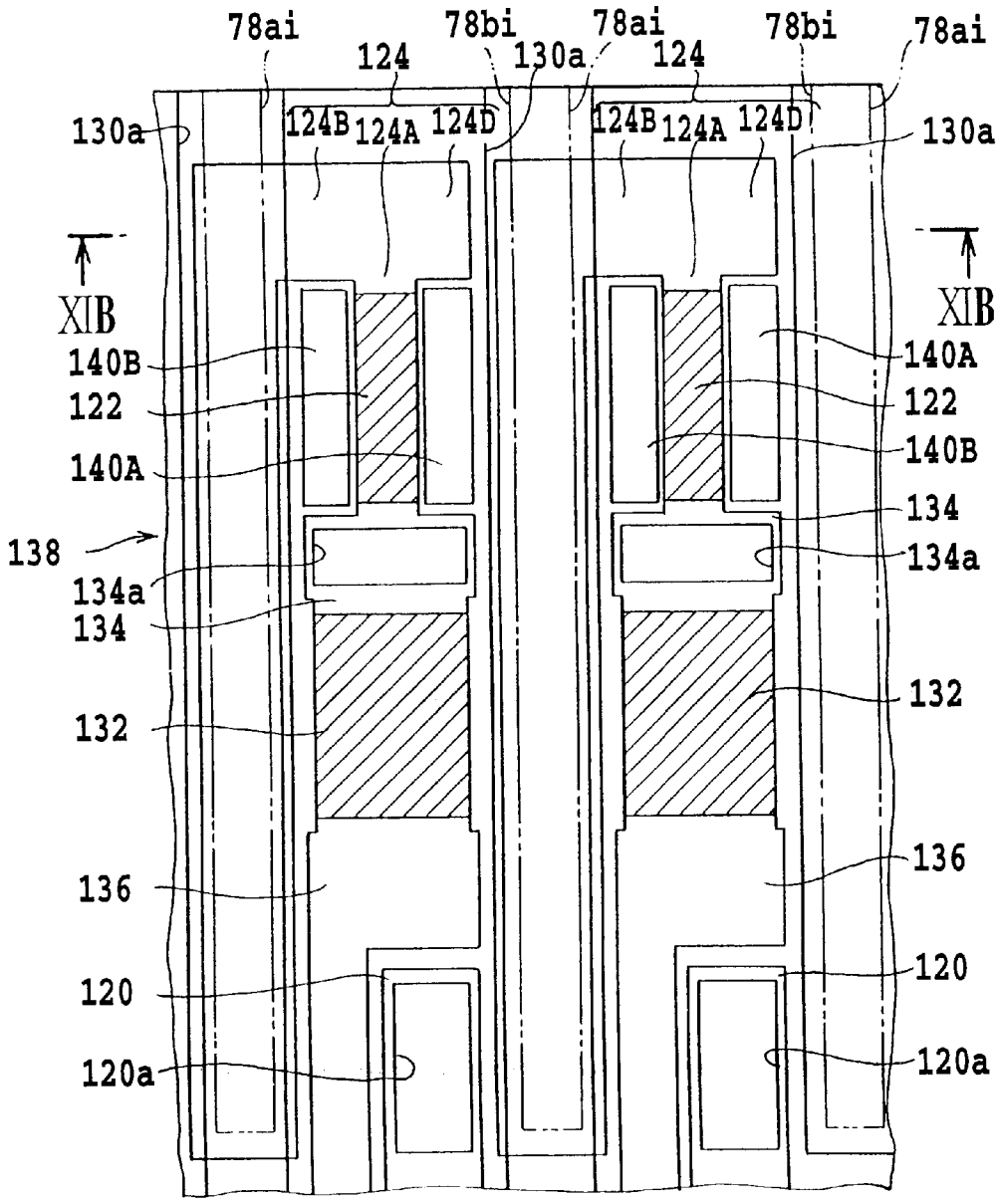
FIG. 11A is a partial sectional diagram showing part of a fourth embodiment of the electro-thermal conversion device board according to the present invention.
Figure 11B:
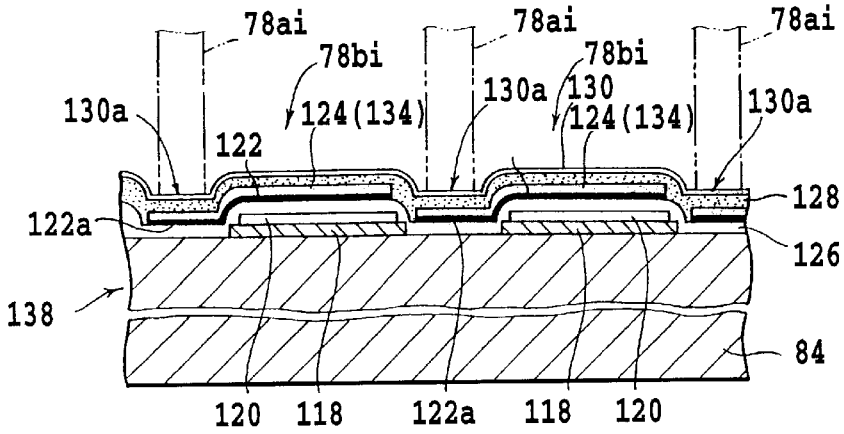
FIG. 11B is a partial sectional diagram taken along line XIB—XIB in FIG. 11A.

FIGS. 11A and 11B show part of a fourth embodiment of the electro-thermal conversion device board according to the present invention.

The example shown in FIGS. 11A and 11B is an electro-thermal conversion device board 138, in which an electrode layers 140A and 140B are additionally formed on the same plane as the heater 122 and the discrete electrode 124 in a space between the heater 122 and each partition wall member 78*ai*.

In FIGS. 11A and 11B, same parts as used in the example shown in FIGS. 6A and 6B are indicated with the same symbols, and detailed description thereof is omitted. The electrode layers 140A and 140B are formed on the same plane as the discrete electrode 124 with a predetermined spacing from the heater 122 and the discrete electrode 124. The electrode layers 140A an 140B are formed by a pattern in a state not electrically connected to the heater 122 and the discrete electrode 124, that is, in a float state.

With such an example, the same effect as the above example can be obtained.

Figure 12A:
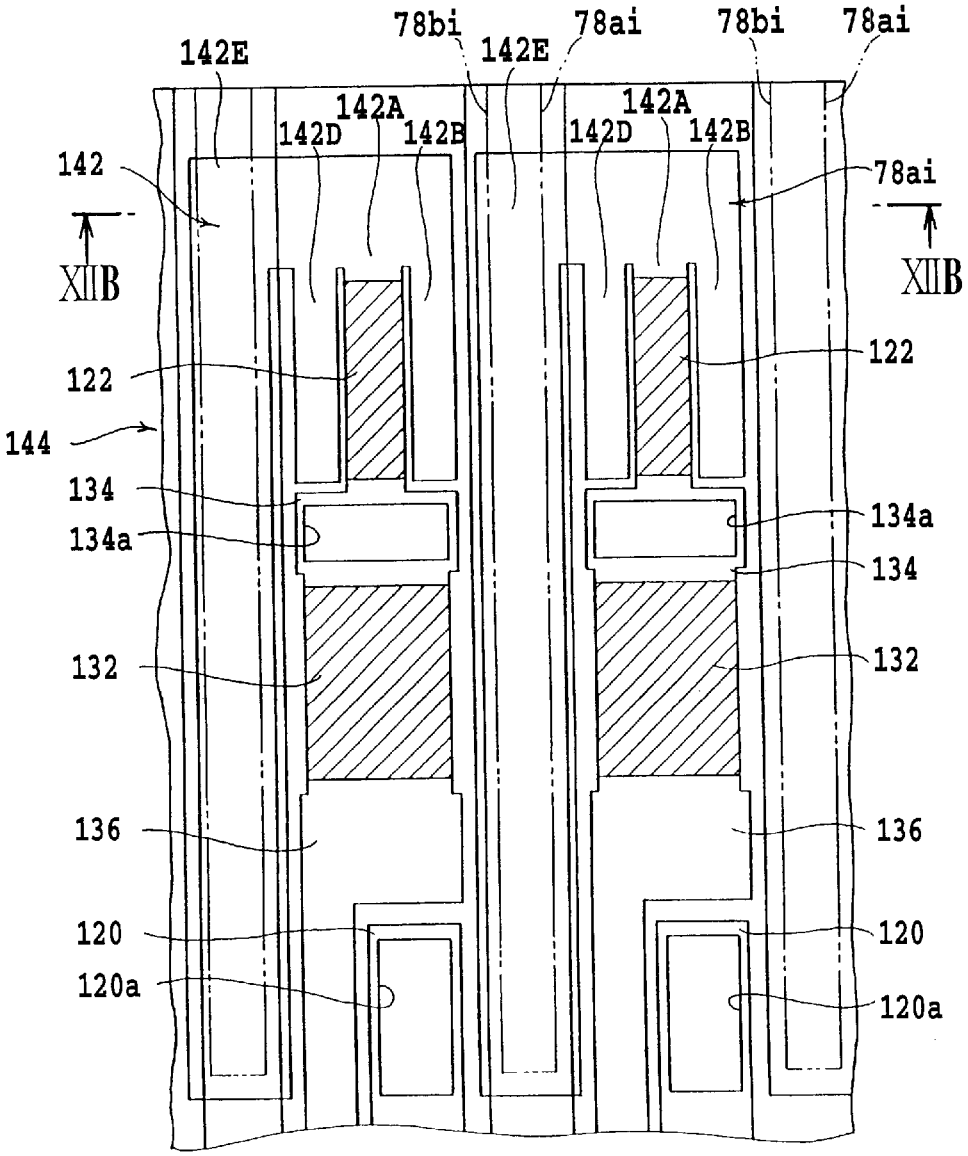
FIG. 12A is a partial sectional diagram showing part of a fifth embodiment of the electro-thermal conversion device board according to the present invention.
Figure 12B:
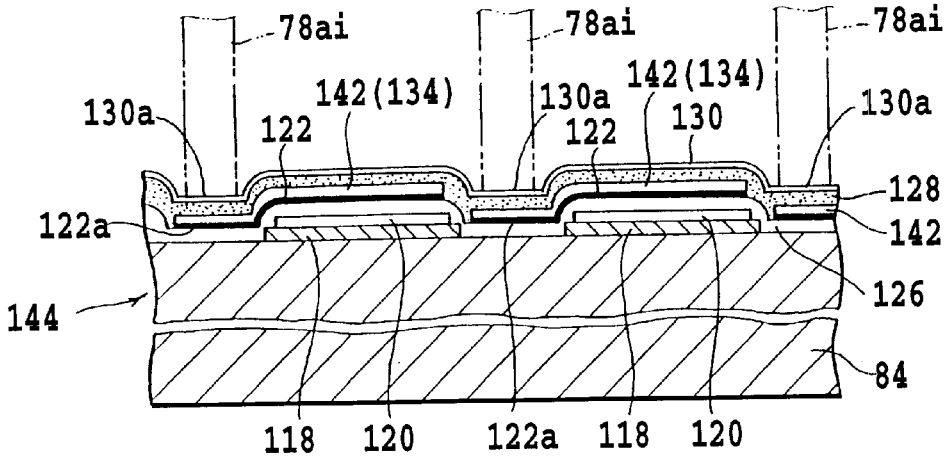
FIG. 12B is a partial sectional diagram taken along line XIIB—XIIB in FIG. 12A.

FIGS. 12A and 12B show a fifth embodiment of the electro-thermal conversion device board according to the present invention.

The example shown in FIGS. 12A and 12B is an electro-thermal conversion device board 144, in which a discrete electrode layer 142 having extension parts 142B and 142D extending along the longer side of the heater 122 and the ink flow passage 78*bi* in the example shown in FIGS. 6A and 6B is formed in a space between the heater 122 and each partition wall member 78*ai*.

In FIGS. 12A and 12B, same parts as used in the example shown in FIGS. 6A and 6B are indicated with the same symbols, and detailed description thereof is omitted.

The discrete electrode layer 142 has a connection part 142A connected to one end of the heater 122, an extension part 142B spreading from the connection part 142A to the vicinity of the adjacent partition wall member 78*ai* and the discrete electrode 142 and bending and extending along the longer side of the heater 122 and the ink flow passage 78*bi* to the end part of the heater 122, an extension part 142D connecting to the connection part 142A in parallel and opposing to the extension part 142B putting the heater 122 between, and a connection part 142E connecting to the connection part 142A oppositely to the extension part 142D and bending and extending along the ink flow passage 78*bi* on the upper surface of an extension 122*a* of the heater 122.

A predetermined gap is formed between the extension parts 142B and 142D and the heater 122.

The position in the thickness direction of the connection part 142E of the discrete electrode layer 142 is lower than that position of the connection part 142A and the extension part 142D. Further, between the connection part 142E of the discrete electrode layer 142 and the extension part 142B of the discrete electrode layer 142 adjacent to each other, a step having a predetermined height is formed. The other end of the connection part 142E is connected to a predetermined terminal part.

With such an example, the same effect as the above example can be obtained.

Figure 13A:
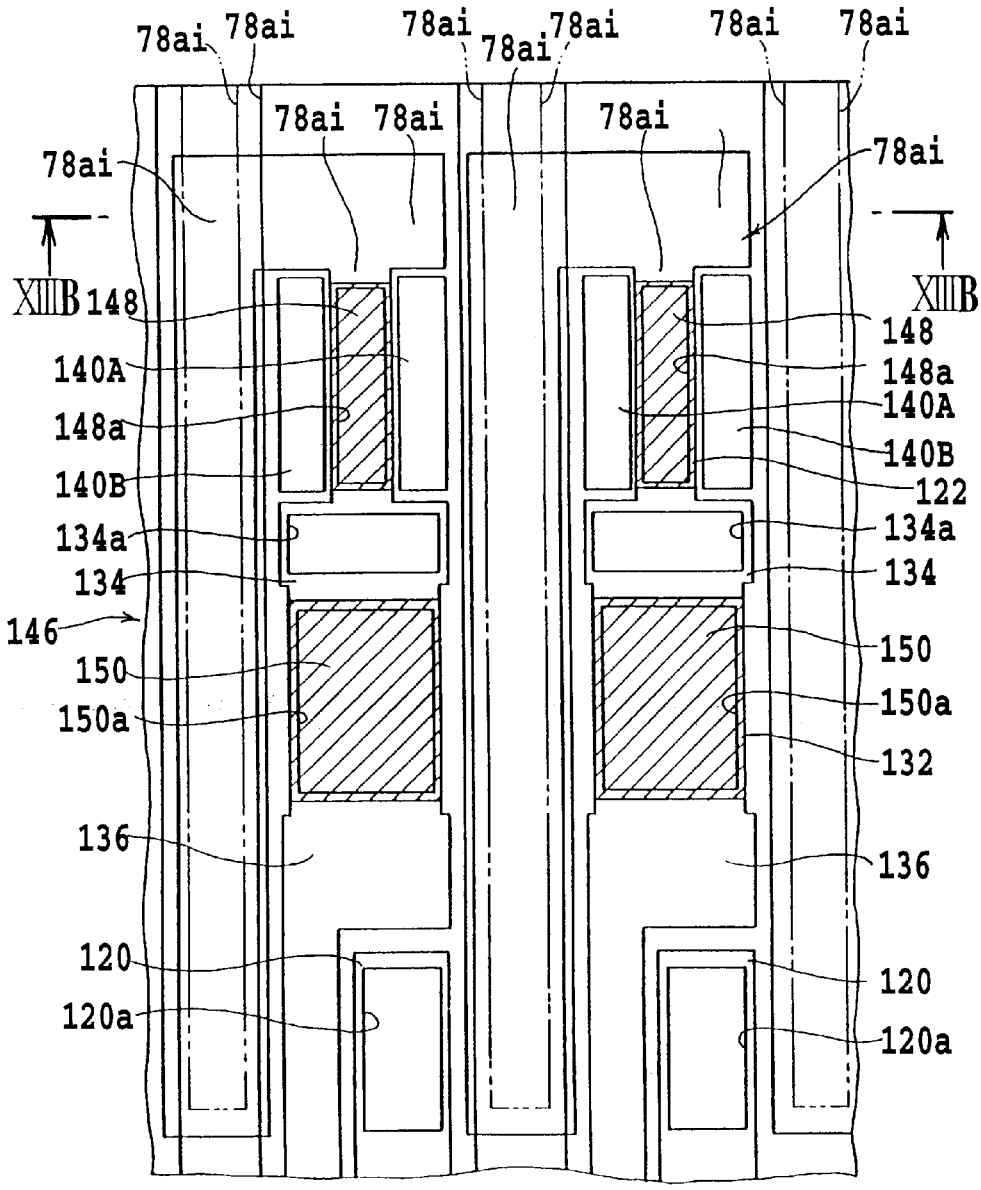
FIG. 13A is a partial sectional diagram showing part of a sixth embodiment of the electro-thermal conversion device board according to the present invention.
Figure 13B:
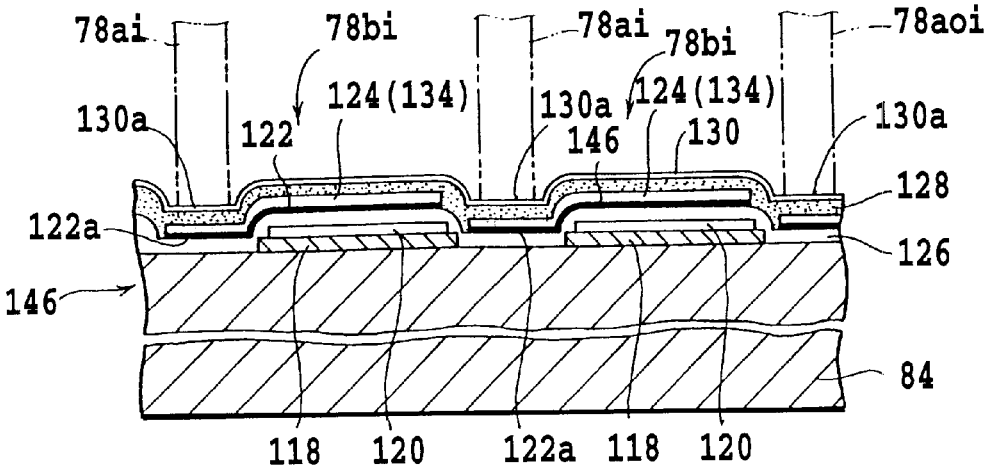
FIG. 13B is a partial sectional diagram taken along line XIIIB—XIIIB in FIG. 13A.

FIGS. 13A and 13B show part of a sixth embodiment of the electro-thermal conversion device board according to the present invention.

The protective layer 128 covering the upper surface of heaters 122 and 132, the discrete electrode layer 124 of the example shown in FIGS. 11A and 11B has a uniform thickness as a whole, whereas, in FIGS. 13A and 13B, the thickness of the heater protection layers 148 and 150 of the part covering the upper surface of the heaters 122 and 132 is formed thinner compared to the thickness of the protective layer 128 covering the upper surface of the discrete electrode layer 124.

The heater protection layers 148 and 150 have areas slightly smaller than the surface areas of the heaters 122 and 132.

This enhances the thermal conductivity of the heater protection layers 148 and 150 covering the upper surface of the heater 122 and 132 compared to the example shown in FIGS. 6A and 6B, thereby improving the heating efficiency of the heaters 122 and 132.

Figure 14:
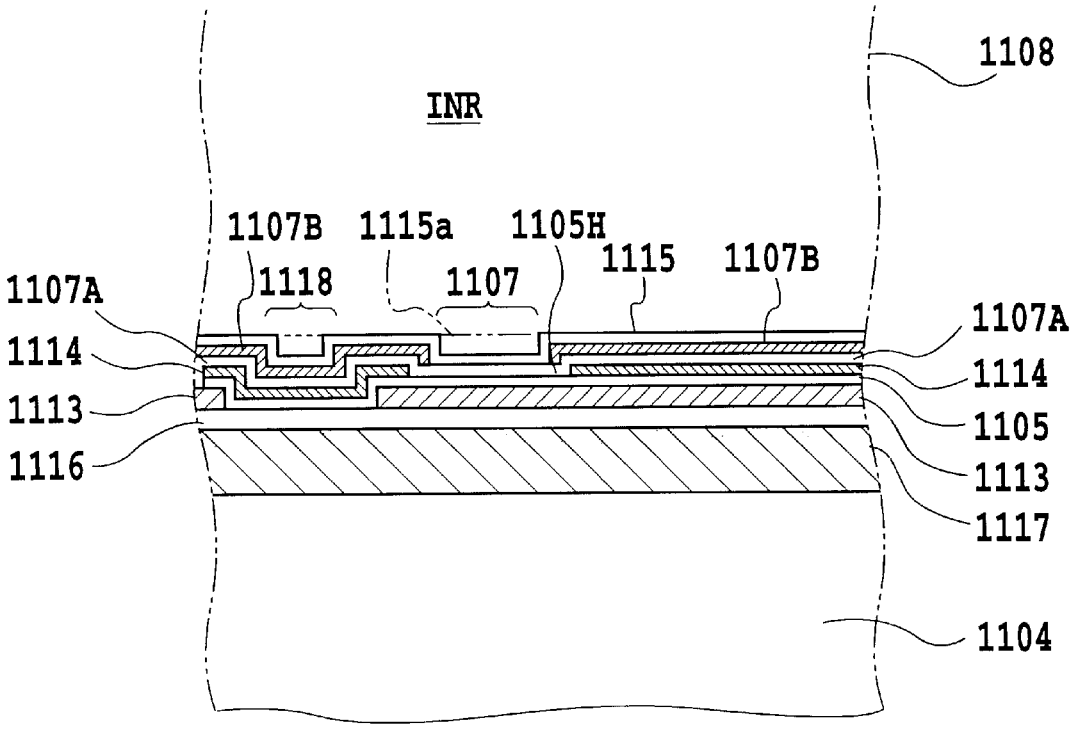
FIG. 14 is a partial sectional diagram showing part of a recording head to which an example of production method of ink-jet recording head according to the present invention is applied.

FIG. 14 shows part of electro-thermal conversion device board to which an example of production method of the ink-jet recording head according to the present invention is applied. FIG. 14 shows a partial sectional diagram taken along its ink flow passage in the above ink ejection member.

In FIG. 14, for example, a substrate 1104 made of silicon is disposed in parallel to a bonding surface of a plurality of flow passage walls 1108 formed on the above-described ink ejection member. With this construction, an ink flow passage INR communicating with each ink ejection port is formed to be surrounded by two adjacent and opposing flow passage walls 1108 and the surface covered with the cavitation resistant film 1115, which will be described later, in the substrate 1104.

In this case, the bonding surface of the flow passage wall 1108 is engaged with a recess 1115*a* formed along the arrangement direction of each ink ejection port corresponding to the bonding surface of each flow passage wall 1108 in the cavitation resistant film 1115 and is positioned relative to a heater 1105H of the substrate 1104. The recess 1115*a* has a predetermined depth same as the above recess 130*a*, and its bottom part is formed at a lower position than the position of the surface of the film covering the upper part of the heater 1105H.

Further, in the cavitation resistant film 1115, a nearly square pit 1118 is formed at the ink ejection port side. Still further, in the cavitation resistant film 1115, a recess 1107 is formed at a position corresponding to the heater 1105H which will be described later, in a direction separated by a predetermined distance from the ink ejection port side relative to the pit 1118. The recess 1107 is formed on the same straight line as the pit 1118 at nearly the center in the width direction in the ink flow passage so that the thickness of the coating layer of the heater 1105H is relatively smaller than other parts.

In the production of such an electro-thermal conversion device board, first, a heat accumulation layer 1117 is formed on the substrate 1104. The heat by heating the substrate 1104. The heat accumulation layer 1117 is formed of an oxide film produced by heating the substrate 1104. Next, a common electrode wiring layer comprising Al, Cu, Al—Si, Al—Cu and the like is formed on the heat accumulation layer 1117 by a sputtering method.

Next, its wiring pattern is formed using photolithography, and etching is performed by a reactive ion etching method. This completes a common electrode wiring layer 1116.

Figure 15A:
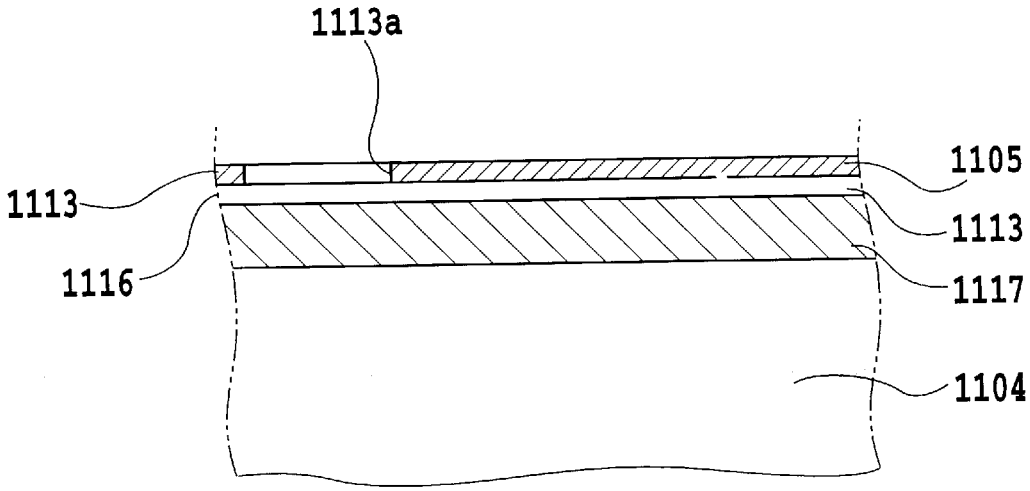
FIGS. 15A and 15B are partial sectional diagrams used for explaining the process in an example of production method of ink-jet recording head according to the present invention.

Next, on the common electrode wiring layer 1116, an insulation film 1113 comprising $SiO_2$ or the like is formed by a sputtering method, a CVD method, or the like. At this moment, as shown in FIG. 15A, a through hole 1113*a* is formed at the position corresponding to the pit 1118.

Next, after the heat generation resistor layer 1105 comprising TaN, TaSiN or the like is formed on the insulation film 1113 by reactive sputtering, a discrete electrode wiring layer 1114 comprising Al, Cu, Al—Cu, Al—Si or the like is formed on the heat generation resistor layer 1105. At this moment, a mask pattern is formed using a photolithographic method, etching is continuously performed to the discrete electrode wiring layer 1114 formed of, for example, Al, TaN or the like and the heat generation resistor layer 1105 by a reactive ion etching method, thereby forming both end parts in the width direction of the ink flow passage in the discrete electrode wiring layer 1114 and the heat generation resistor layer 1105.

Figure 15B:
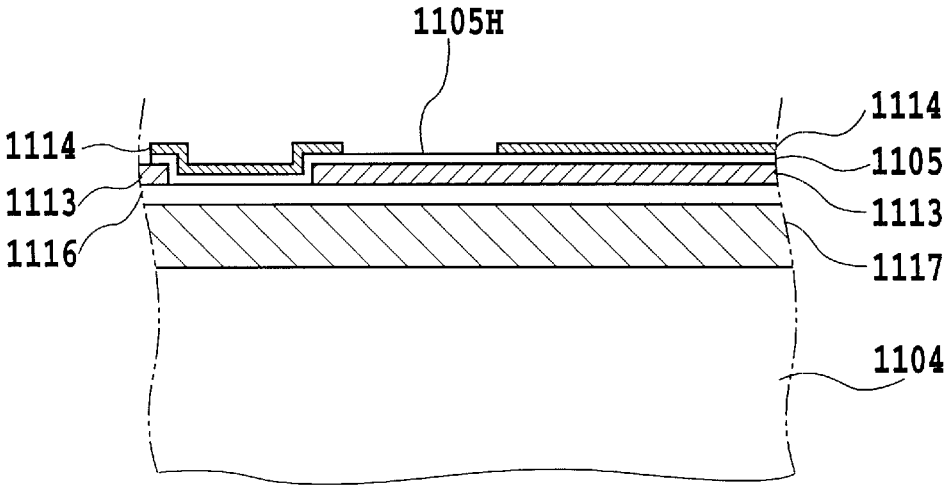

Next, as shown in FIG. 15B, in order to expose the heater 1105H, for example, part of the discrete electrode wiring layer 1114 comprising Al is removed by wet etching. Therefore, the removed part is the heater 1105H.

Figure 16A:
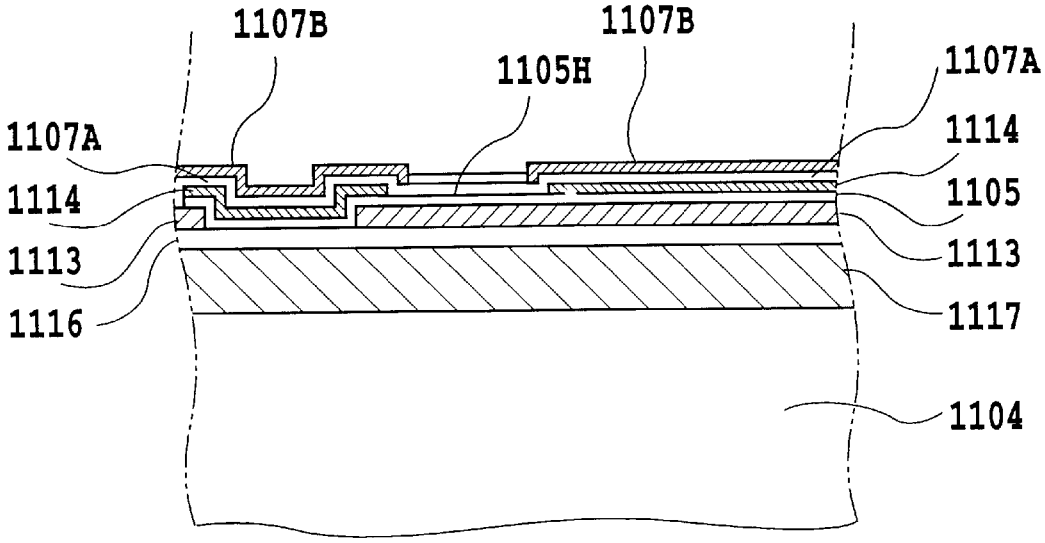
FIGS. 16A and 16B are partial sectional diagrams used for explaining the process in an example of production method of ink-jet recording head according to the present invention.

Next, using a plasma CVD method, as shown in FIG. 16A, a first protective film 1107A as a protective film is formed on the discrete electrode wiring layer 1114, and a second protective film 1107B is formed on the first protective film 1107A.

Next, patterning is performed using a photolithographic method, and, using hot phosphoric acid, wet etching is performed for 1 to 2 minutes. In this case, etching is completed at the point of time when the second protective film 1107B is etched out.

Figure 16B:
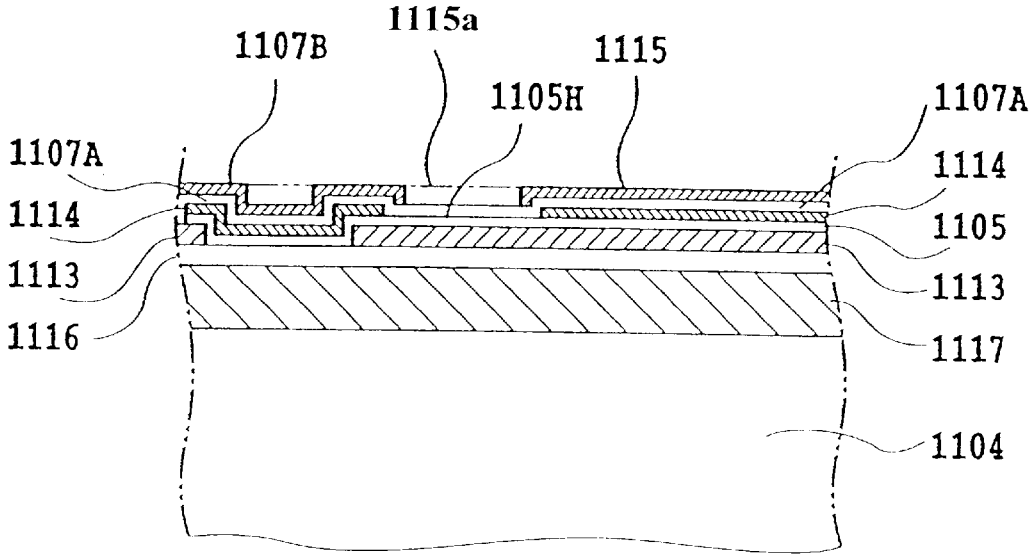
Figure 17A:
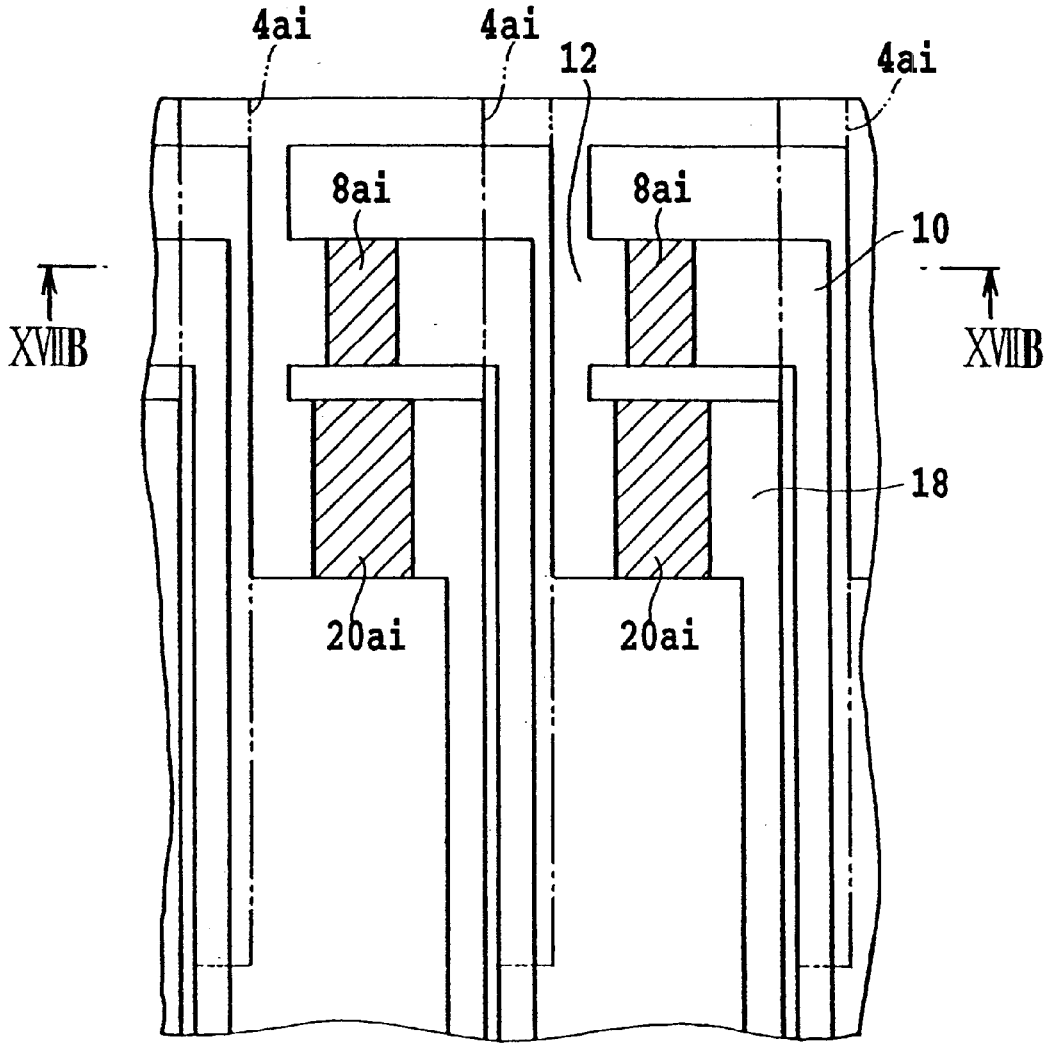
FIG.17A PRIOR ART
FIG. 17A is a plane diagram showing part of a prior art electro-thermal conversion device board.
Figure 17B:
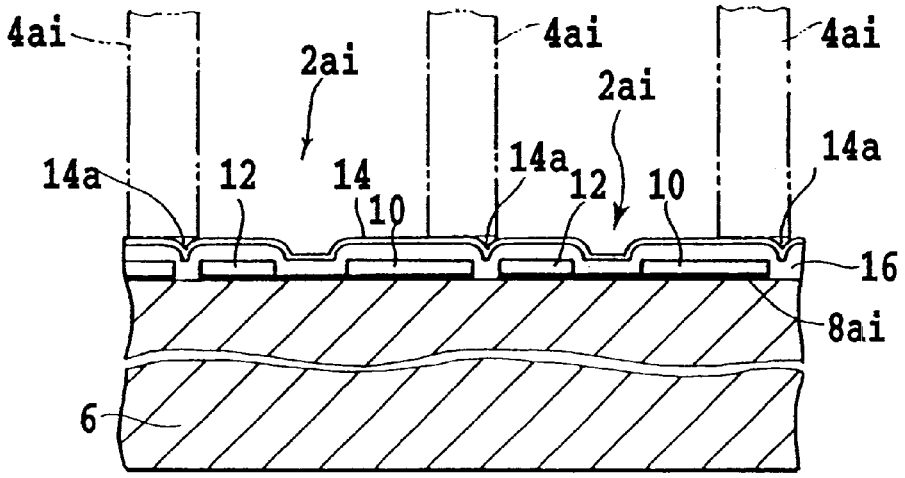
FIG.17B PRIOR ART
FIG. 17B is a partial sectional diagram taken along line XVIIB—XVIIB in FIG. 17A.

As a result, as shown in FIG. 16B, the first protective film 1107A smaller in etching rate than the second protective film 1107B is remained. In addition, the recess 1115*a* for contacting against the bonding surface of the flow passage wall 1108 is formed.

Next, the cavitation resistant film 1115 as an ink resistant film of tantalum is formed by a sputtering method. Therefore, since the coating layer covering the heater 1105H is the first protective film 1107A and the cavitation resistant film 1115, the thickness of the coating layer covering the heater 1105H is smaller than other parts, as shown in FIG. 14, the recess 1107 is formed at the position corresponding to the heater 1105H.

After the cavitation resistant film 1115 is formed, the bonding surface of the flow passage wall 1108 is engaged with the recess 1115*a* formed in the cavitation resistant film 1115 to be positioned relative to the heater 1105H of the substrate 1104 and bonded.

In the thus obtained electro-thermal conversion device board, since the process for locally thinning part of the protective film corresponding to the heater 1105 and the process for forming the recess 1115*a* for contacting against the bonding surface of the flow passage wall 1108 are performed simultaneously with the process for removing by patterning only one layer of the two stacked protective films, effects of overetching or step coverage are reduced even when a number of heat generation resistors are closely disposed by a high-density multi-nozzle configuration.

As a result, formation of the recess 1115*a* is performed with good accuracy. When comparative experiments are conducted by the inventors, in which the ink-jet recording head is produced using the above board and tested for power consumption required for bubble generation and stability of ink ejection, it has been confirmed that a reduction in power consumption is noted compared to the construction where one layer of the protective film is not removed as described above, and stability of ink ejection is good.

In the above-described examples, the present invention is applied to the recording head 75 for ejecting ink, however, the present invention is not limited to such examples, but an example of the present invention may be applied to the recording head 75 for ejecting a processing liquid for insolubilizing an ink dye.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet recording head comprising:

a plurality of ejection ports for ejecting ink, a substrate provided with a plurality of electro-thermal conversion devices for applying thermal energy to the ink and a plurality of recesses between said electro-thermal conversion devices, said electro-thermal conversion devices comprising heat generation resistor layers including wiring electrodes electrically connected to said heat generation resistor layers;

a wall member integrally having a plurality of flow passage walls for forming flow passages for the ink, each of said flow passages being provided with a plurality of said electro-thermal conversion devices and said flow passage walls being engaged respectively with said recesses to join said substrate with said wall member to form said flow passages, wherein said substrate further comprises a heat accumulation layer below said heat generation resistor layer, said wiring electrodes have an upper wiring electrode layer formed above said heat generation resistor layer and a lower wiring electrode layer formed below said heat generation resistor layer through said heat accumulation layer, said upper wiring electrode layer and said lower wiring electrode layer are provided together at said flow passages, either said upper wiring electrode layer or said lower wiring electrode layer is provided at a portion that corresponds to said recesses, and each of said recesses formed of a cutout having a width wider than each of said flow passage walls.

2. The ink-jet recording head as claimed in claim 1, wherein said plurality of electro-thermal conversion devices in each of said flow passages are arranged lengthwise along said flow passage, and said lower wiring electrode layer extends to a position beneath one of said plurality of electro-thermal conversion devices positioned closest to an ejection port side of each of said flow passages.

3. An ink-jet recording apparatus comprising:

the ink-jet recording head as claimed in claim 2 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

4. The ink-jet recording head as claimed in claim 1, wherein said lower wiring electrode layer is electrically connected to said respective electro-thermal conversion devices provided for any given one of said flow passages via a through-hole provided between said electro-thermal conversion devices provided for said given one of said flow passages, said through-hole being disposed in an interlayer insulation layer provided between said lower layer wiring electrode layer and said heat generation resistor layer.

5. An ink-jet recording apparatus comprising:

the ink-jet recording head as claimed in claim 4 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

6. The ink-jet recording head as claimed in claim 4, wherein said wiring electrode comprises a discrete electrode layer electrically connected respectively to said plurality of electro-thermal conversion devices and a common electrode layer laminated through an insulation layer beneath said discrete electrode layer electrically connected respectively to said plurality of electro-thermal conversion devices.

7. The ink-jet recording head as claimed in claim 6, wherein said common electrode layer is electrically connected to branch connection parts formed between said electro-thermal conversion devices, and said electro-thermal conversion devices are supplied respectively with power through said branch connection parts.

8. The ink-jet recording head as claimed in claim 6, wherein said electro-thermal conversion devices provided for any given one of said flow passages differ from each other in heat generation capacity per unit time.

9. The ink-jet recording head as claimed in claim 1, wherein of said wiring electrodes, for each of said flow passages, only a selection electrode of an electro-thermal conversion device positioned at a position closest to an ejection port side of said flow passage is provided in a lower part of each of said flow passage walls forming said flow passage.

10. An ink-jet recording apparatus comprising:

the ink-jet recording head as claimed in claim 9 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

11. An ink-jet recording apparatus comprising:

the ink-jet recording head as claimed in claim 1 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

12. An ink-jet recording head as claimed in claim 1, wherein said upper wiring electrode layer has an end surface at an ejection port side of said flow passages.

13. The ink-jet recording head as claimed in claim 12, wherein each of said flow passages is provided therein with two electro-thermal conversion devices arranged lengthwise along said flow passage, and a width of an electro-thermal conversion device disposed at said ejection port side is smaller than a width of the other electro-thermal conversion device.

14. The ink-jet recording head as claimed in claim 13, wherein the central axes of said two electro-thermal conversion devices disposed in a given one of said flow passages coincide with each other.

15. An ink-jet recording apparatus comprising:

the ink-jet recording head as claimed in claim 14 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

16. The ink-jet recording head as claimed in claim 13, wherein, for each of said flow passages, said upper layer wiring electrode layer extends in a lengthwise direction of said flow passages on both sides of said electro-thermal conversion device disposed at said ejection port side.

17. An ink-jet recording apparatus comprising:

the ink-jet recording head as claimed in claim 16 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

18. The ink-jet recording head as claimed in claim 13, wherein said upper layer wiring electrode layer has a pattern on both sides of said electro-thermal conversion device disposed at said ejection port side, said pattern being not electrically connected to said upper layer wiring electrode layer or to a heater arranged on said heat generation resistor layer.

19. An ink-jet recording apparatus comprising:

the ink-jet recording head as claimed in claim 18 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

20. An ink-jet recording apparatus comprising:

the ink-jet recording head as claimed in claim 13 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

21. An ink-jet recording apparatus comprising:

the ink-jet recording head as claimed in claim 12 for performing a recording operation on a recording surface of a recording medium;

recording head moving means for moving said ink-jet recording head relative to the recording surface of the recording medium; and a control part for causing said recording head moving means to perform the operation of relative movement of said ink-jet recording head and for causing said ink-jet recording head to perform the recording operation.

22. A production method of an ink-jet recording head comprising:

a substrate having thereon a plurality of heat generation resistors for applying heat to ink to eject the ink, wiring electrodes electrically connected to the heat generation resistors, and a protective film provided on the heat generation resistors and the wiring electrodes for protecting the heat generation resistors and the wiring electrodes, and a wall member joined to the substrate and integrally having a plurality of flow passage walls for forming flow passages, the substrate and the wall member being joined to form the flow passages, the method comprising:

a step for forming a protective film on the heat generation resistors and the wiring electrodes;

a step for thinning the protective film locally to form recesses between the heat generation resistors; and a step for joining the flow passage walls with the recesses provided between the heat generation resistors to align the flow passages with the heat generation resistors, wherein the wiring electrodes have an upper wiring electrode layer formed above the heat generation resistor layer and a lower wiring electrode layer formed below the heat generation resistor layer through the heat accumulation layer, the upper wiring electrode layer and the lower wiring electrode layer are provided together at the flow passages, either of the upper wiring electrode layer and the lower wiring electrode layer is provided at a portion that corresponds to the recesses.

23. The production method of an ink-jet recording head as claimed in claim 22, wherein two protective films different from each other are formed in layers in the step for forming a protective film and one of the protective films is removed in the step for thinning the protective film.

* * * * *

UNITED STATES PATENT AND TRADEMARK OFFICE

CERTIFICATE OF CORRECTION

PATENT NO. : 6,443,563 B1
DATED : September 3, 2002
INVENTOR(S) : Ichiro Saito et al.

It is certified that error appears in the above-identified patent and that said Letters Patent is hereby corrected as shown below:

Title page,
Item [56], References Cited, FOREIGN PATENT DOCUMENTS,
"EP 816 084 A2*" should read -- EP 0 816 084 A2* --.
Item [74], *Attorney, Agent, or Firm*, "Firzpatrick," should read -- Fitzpatrick, --.

Drawings,
Sheet 6, Figure 5, "RECORDINBG" should read -- RECORDING --.

Column 1,
Line 12, "10-311050" should read -- and 10-311050 --;
Line 52, "liquid-droplet" should read -- liquid droplet --; and
Line 58, "in which" should read -- which --.

Column 2,
Line 11, "integer)of" should read -- integer) of --.

Column 3,
Line 27, "crosstalk," should read -- crosstalk; --;
Line 49, "part," should read -- part; --; and
Line 53, "a increased" should read -- an increased --.

Column 4,
Line 66, "an first" should read -- a first --.

Column 7,
Line 37, "of he" should read -- of the --.

Column 8,
Line 55, "78" should read -- 78. --; and
Line 57, "between of" should read -- of --.

Column 9,
Line 47, "End" should read -- The end --; and
Line 58, "width" should read -- the width --.

UNITED STATES PATENT AND TRADEMARK OFFICE

CERTIFICATE OF CORRECTION

PATENT NO. : 6,443,563 B1
DATED : September 3, 2002
INVENTOR(S) : Ichiro Saito et al.

It is certified that error appears in the above-identified patent and that said Letters Patent is hereby corrected as shown below:

Column 11,
Line 12, "closely" should read -- is closely -- and
"bottom" should read -- the bottom --;
Line 19, "134," should read -- 134 and --;
Line 20, "sharing" should read -- the shared --;
Line 36, "remained" should read -- remaining --; and
Line 39, "by" should read -- by an --.

Column 12,
Line 18, "7,in" should read -- 7, in --;
Line 39, "8B,holes" should read -- 8B, holes --; and
Line 44, "Ta-SiN(tantalum" should read -- Ta-SiN (tantalum --.

Column 13,
Line 11, "90,the" should read -- 90, and the --;
Line 31, "small" should read -- smaller --; and
Line 43, "in" should read -- and is --.

Column 14,
Line 20, "an" should be deleted;
Lines 25 and 47, "same" should read -- the same --;
Line 32, "an" should read -- and --; and Column 16,
Line 1, "The heat by heating the substrate" should be deleted; and
Line 2, "1104." should be deleted.

UNITED STATES PATENT AND TRADEMARK OFFICE

CERTIFICATE OF CORRECTION

PATENT NO. : 6,443,563 B1
DATED : September 3, 2002
INVENTOR(S) : Ichiro Saito et al.

It is certified that error appears in the above-identified patent and that said Letters Patent is hereby corrected as shown below:

Column 17,
Line 14, "ink," should read -- ink; --.

Signed and Sealed this

Second Day of December, 2003

JAMES E. ROGAN
*Director of the United States Patent and Trademark Office*